US010429756B2

(12) United States Patent
Fuwa et al.

(10) Patent No.: US 10,429,756 B2
(45) Date of Patent: Oct. 1, 2019

(54) TONER, DEVELOPER, PROCESS CARTRIDGE, IMAGE FORMING APPARATUS, IMAGE FORMING METHOD, AND METHOD FOR MANUFACTURING TONER

(71) Applicants: Kazuoki Fuwa, Shizuoka (JP); Hiroshi Yamashita, Shizuoka (JP); Yuka Mizoguchi, Shizuoka (JP); Shizuka Hashida, Saitama (JP); Toma Takebayashi, Shizuoka (JP); Junko Yamaguchi, Shizuoka (JP); Maia Kamei, Tokyo (JP); Keisuke Ohta, Shizuoka (JP)

(72) Inventors: Kazuoki Fuwa, Shizuoka (JP); Hiroshi Yamashita, Shizuoka (JP); Yuka Mizoguchi, Shizuoka (JP); Shizuka Hashida, Saitama (JP); Toma Takebayashi, Shizuoka (JP); Junko Yamaguchi, Shizuoka (JP); Maia Kamei, Tokyo (JP); Keisuke Ohta, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/009,462

(22) Filed: Jun. 15, 2018

(65) Prior Publication Data

US 2018/0364600 A1 Dec. 20, 2018

(30) Foreign Application Priority Data

Jun. 20, 2017 (JP) ..... 2017-120688
Jun. 30, 2017 (JP) ..... 2017-129533
May 31, 2018 (JP) ..... 2018-104805

(51) Int. Cl.
*G03G 9/08* (2006.01)
*G03G 9/09* (2006.01)
*G03G 15/08* (2006.01)

(52) U.S. Cl.
CPC ..... *G03G 9/0902* (2013.01); *G03G 9/0906* (2013.01); *G03G 9/0912* (2013.01);
(Continued)

(58) Field of Classification Search
CPC .. G03G 9/0924; G03G 9/0902; G03G 9/0906; G03G 9/0912
(Continued)

(56) References Cited

U.S. PATENT DOCUMENTS 9,651,884 B2 * 5/2017 Urabe ..... G03G 9/0823
2008/0193868 A1 8/2008 Schuster et al.
(Continued)

FOREIGN PATENT DOCUMENTS

EP 3 376 291 A1 9/2018
JP 2008-139464 6/2008
(Continued)

OTHER PUBLICATIONS

Partial European Search Report dated Oct. 25, 2018 in corresponding European Patent Application No. 18176561.1, 12 pages.
(Continued)

*Primary Examiner* — Mark A Chapman
(74) *Attorney, Agent, or Firm* — Oblon, McClelland, Maier & Neustadt, L.L.P.

(57) ABSTRACT

A toner is provided. The toner comprises a glittering pigment and a coloring pigment. The glittering pigment is disposed inside the toner. The coloring pigment comprises a yellow pigment comprising an isoindoline pigment.

10 Claims, 3 Drawing Sheets

(52) U.S. Cl.
CPC ..... *G03G 9/0924* (2013.01); *G03G 9/0926* (2013.01); *G03G 15/08* (2013.01); *G03G 2215/0604* (2013.01)

(58) Field of Classification Search
USPC ..... 430/107.1
See application file for complete search history.

(56) References Cited

U.S. PATENT DOCUMENTS

| | | | | |
|---|---|---|---|---|
| 2011/0236048 | A1* | 9/2011 | Mukai ..... | G03G 15/2039 399/70 |
| 2014/0023964 | A1 | 1/2014 | Hirai et al. | |
| 2018/0267420 | A1 | 9/2018 | Yamashita et al. | |

FOREIGN PATENT DOCUMENTS

| | | | |
|---|---|---|---|
| JP | 2009-501349 | | 1/2009 |
| JP | 2012-163695 | | 8/2012 |
| JP | 2013-057906 | | 3/2013 |
| JP | 2014-134636 | | 7/2014 |
| JP | 2016-139053 | | 8/2016 |
| JP | 2016-156963 | | 9/2016 |
| JP | 2018-36532 | A | 3/2018 |
| WO | WO2007/006481 | A1 | 1/2007 |

OTHER PUBLICATIONS

U.S. Appl. No. 15/919,256, filed Mar. 13, 2018, Hiroshi Yamashita, et al.
U.S. Appl. No. 15/904,551, filed Feb. 26, 2018, Yuka Mizoguchi, et al.

* cited by examiner

TONER, DEVELOPER, PROCESS CARTRIDGE, IMAGE FORMING APPARATUS, IMAGE FORMING METHOD, AND METHOD FOR MANUFACTURING TONER

CROSS-REFERENCE TO RELATED APPLICATIONS

This patent application is based on and claims priority pursuant to 35 U.S.C. § 119(a) to Japanese Patent Application Nos. 2017-120688, 2017-129533, and 2018-104805 filed on Jun. 20, 2017, Jun. 30, 2017, and May 31, 2018, respectively, in the Japan Patent Office, the entire disclosure of each of which is hereby incorporated by reference herein.

BACKGROUND

Technical Field

The present disclosure relates to a toner, a developer, a process cartridge, an image forming apparatus, an image forming method, and a method for manufacturing toner.

Description of the Related Art

In electrophotographic image formation, a glittering toner that contains a glittering pigment has been used to form an image having metallic luster.

There have been attempts to impart color tone to a glittering toner image by using a glittering toner and a yellow toner in combination, and to further impart light resistance thereto by using a glittering pigment and a yellow pigment in combination.

Glittering pigments are, however, highly electroconductive and therefore degrade charging ability of the toner. When a glittering pigment is used in combination with other pigments, charging ability more remarkably degrades. Low charging ability causes an undesired phenomenon such as background stains.

SUMMARY

In accordance with some embodiments of the present invention, a toner is provided. The toner comprises a glittering pigment and a coloring pigment. The glittering pigment is disposed inside the toner. The coloring pigment comprises a yellow pigment comprising an isoindoline pigment.

In accordance with some embodiments of the present invention, another toner is also provided. The toner comprises glittering pigment particles and coloring pigment particles, and 80% or more of the coloring pigment particles are disposed at a position A and 75% or more of the glittering pigment particles are disposed at a position B, where the position A and the position B are on a line connecting a center of gravity of the toner as a start point to a surface of the toner as an end point via a center of gravity of each of the coloring pigment particles and glittering pigment particles, and a distance from the start point to the position A is 0.6 times or more a total distance between the start point and the end point and a distance from the start point to the position B is less than 0.6 times the total distance.

In accordance with some embodiments of the present invention, a developer is provided. The developer comprises the above-described toner.

In accordance with some embodiments of the present invention, a process cartridge detachably mountable on an image forming apparatus is provided. The process cartridge includes a photoconductor and a developing device containing the above-described developer. The developing device is configured to develop an electrostatic latent image on the photoconductor with the developer.

In accordance with some embodiments of the present invention, an image forming apparatus is provided. The image forming apparatus includes a photoconductor, an electrostatic latent image forming device, a developing device containing the above-described developer, a transfer device, and a fixing device. The electrostatic latent image forming device is configured to form an electrostatic latent image on the photoconductor. The developing device is configured to develop the electrostatic latent image on the photoconductor with the developer to form a toner image. The transfer device is configured to transfer the toner image onto a recording medium. The fixing device is configured to fix the transferred toner image on the recording medium.

In accordance with some embodiments of the present invention, an image forming method is provided. The image forming method includes the steps of: forming an electrostatic latent image on a photoconductor; developing the electrostatic latent image with the above-described developer to form a toner image; transferring the toner image onto a recording medium; and fixing the transferred toner image on the recording medium.

In accordance with some embodiments of the present invention, a method for manufacturing toner is provided. The method includes the steps of: dispersing an organic liquid, comprising a glittering pigment and a coloring pigment, in an aqueous medium to form an oil-in-water (O/W) emulsion, wherein the coloring pigment comprises a yellow pigment comprising an isoindoline pigment.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1A:
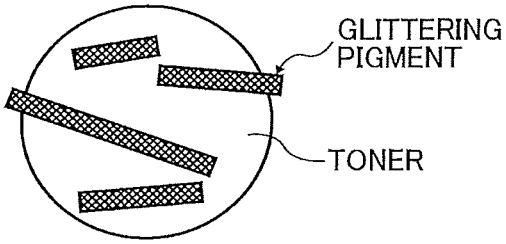
FIG. 1A is a schematic cross-sectional illustration of a toner according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, a glittering toner with an excellent color tone that suppresses deterioration of charging ability is provided.

Toner

The toner according to an embodiment of the present invention comprises a glittering pigment and a coloring pigment. The glittering pigment is disposed inside the toner. The coloring pigment comprises a yellow pigment, and the yellow pigment comprises an isoindoline pigment.

A toner containing a glittering pigment is capable of forming an image having metallic luster. Examples of the glittering pigment include, but are not limited to, particles of metals such as aluminum. The glittering pigment is, however, highly electro conductive and therefore degrades charging ability of the toner. When the glittering pigment is used in combination with a yellow pigment for the purpose of adjusting hue, charging ability of the toner is more degraded, causing deterioration of the resulting image quality relating to charging property, such as background stains.

As a result of the study by the inventors, it comes to a conclusion that a combination use of a glittering pigment with an isoindoline pigment, as a yellow pigment, suppresses deterioration of charging ability while maintaining excellent hue. Although a reason for this has not been cleared out, it is considered that electrical resistance of the toner is kept high due to high dispersibility of isoindoline pigments in resins, even when a glittering pigment is used in combination.

According to an embodiment of the present invention, the glittering pigments is disposed inside the toner, so that the glittering pigment having conductivity will not come into contact with adjacent toner particles. By disposing the glittering pigment inside the toner particle, deterioration of charging ability is prevented and the occurrence of background stains is thereby suppressed. Thus, a glittering toner with an excellent color tone that suppresses deterioration of charging ability is provided.

Glittering Pigment

Specific examples of the glittering pigment include, but are not limited to: powders of metals such as aluminum, brass, bronze, nickel, stainless steel, zinc, copper, silver, gold, and platinum; and metal-deposited flake-like glass powder.

The glittering pigment is preferably surface-treated for dispersibility and stain resistance, and may be coated with a surface treatment agent, silane coupling agent, titanate coupling agent, fatty acid, silica particle, acrylic resin, or polyester resin.

Preferably, the glittering pigment is in a scale-like (plate-like) or flat shape having a light reflective surface, to exhibit glittering property. More preferably, the glittering pigment is in a thin-plate-like shape, so that one particle of the pigment can provide a plane surface having a certain degree of area with a small volume. One type of glittering pigment may be used alone or two or more types of glittering pigments may be used in combination. For adjusting color tone, the glittering pigment may be used in combination with other coloring agents such as dyes and pigments.

Glittering pigments having a plane surface, such as those in a scale-like or flat shape, are preferable since they can be arranged in parallel inside the toner while forming a stacked structure.

Figure 1B:
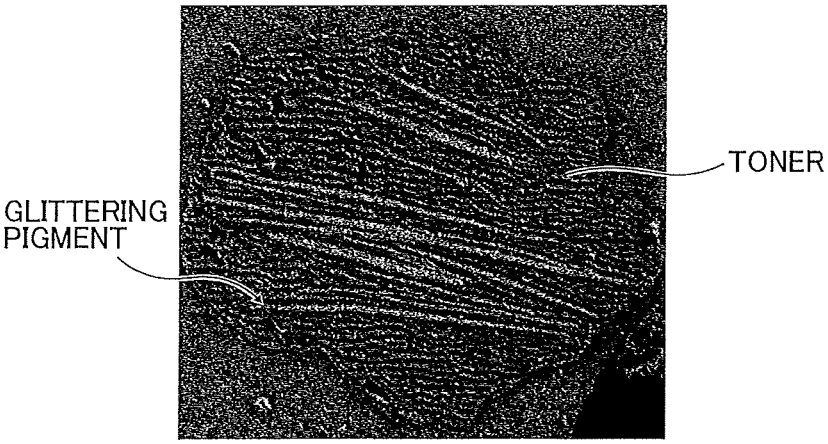
FIG. 1B is a cross-sectional image of a toner according to an embodiment of the present invention.
Figure 2A:
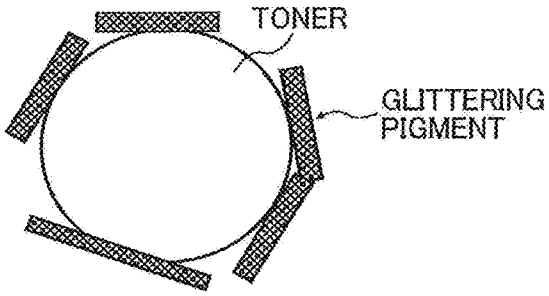
FIG. 2A RELATED ART
FIGS. 2A and 2B are schematic cross-sectional illustrations of related-art toners.
Figure 2B:
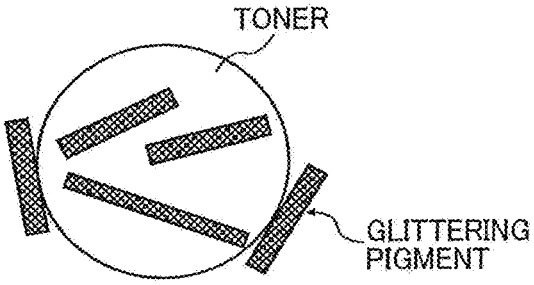
FIG. 2B RELATED ART
Figure 2C:
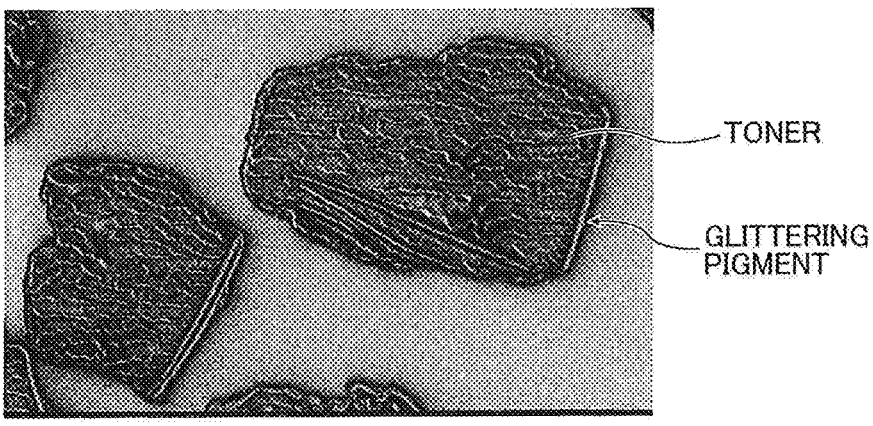
FIG. 2C RELATED ART
FIG. 2C is a cross-sectional image of a related-art toner.

As described above, the glittering pigment is disposed inside the toner. In the present embodiment, a state in which the glittering pigment is disposed inside the toner refers to a state in which the center of each glittering pigment particle in a longitudinal direction thereof is all disposed inside the toner. FIGS. 1A and 1B are a schematic cross-sectional illustration and a cross-sectional image, respectively, of the toner according to an embodiment of the present invention within which the glittering pigment is disposed. FIGS. 2A and 2B are schematic cross-sectional illustrations of related-art toners within which the glittering pigment is not disposed. FIG. 2C is a cross-sectional image of a related-art toner inside which the glittering pigment is not disposed. Whether or not the glittering pigment is disposed inside the toner is determined by observing a cross-section of the toner with a scanning electron microscope (SEM) and performing elemental analysis with an energy dispersive X-ray analyzer (EDS).

The method of disposing the glittering pigment inside the toner is not limited to any particular process. As an example, it is preferable to use a glittering pigment coated with a hydrophobic substance having affinity for toner binder resin, in the process of manufacturing toner. Such a surface-coated glittering pigment may be obtained by grinding and polishing a glittering pigment in a ball mill along with a long-chain alkyl fatty acid (e.g., stearic acid and oleic acid). A surface-coated glittering pigment may also be obtained by dispersing a glittering pigment in a hydrophobic organic solvent such as toluene, propyl acetate, and ethyl acetate, serving as a dispersion medium, and further dissolving a polyester resin, an acrylic silicone resin, etc., therein. It is also possible to react the glittering pigment with a surface active hydrogen group of a silane coupling agent, etc. These processes are particularly effective for chemical toner manufacturing processes in which toner particles are produced in an aqueous medium.

Preferably, the content of the glittering pigment is from 5% to 50% by weight based on a total weight of the toner.

Coloring Pigment

According to an embodiment of the present invention, the coloring pigment comprises a yellow pigment, and the yellow pigment comprises an isoindoline pigment. The isoindoline pigment comprises isoindoline represented by the following formula (1).

Formula (1)

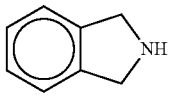

A combination use of the glittering pigment with the isoindoline pigment suppresses deterioration of toner quality relating to charging property while maintaining excellent hue.

Specific examples of the isoindoline pigment include, but are not limited to, C.I. Pigment Yellow 139 and C.I. Pigment Yellow 185. Among these, C.I. Pigment Yellow 185 is preferable for improving charging ability.

The coloring pigment may further comprise a pigment other than the yellow pigment, and preferred is a magenta pigment. By comprising the magenta pigment, the hue can be more extended. In addition, glittering property is improved and thereby vivid gold color is exhibited.

Specific examples of the magenta pigment include, but are not limited to, C.I. Pigment Red 122 and C.I. Pigment Yellow 269.

Preferably, the content of the coloring pigment is from 10 to 35 parts by weight, more preferably from 20 to 30 parts by weight, based on 100 parts by weight of the glittering pigment. When the content is less than 10 parts by weight, coloring power may decrease and undesired hue may be exhibited (i.e., vivid gold color cannot be exhibited). When the content is in excess of 35 parts by weight, the pigment may be insufficiently dispersed in the toner, thereby causing deterioration of coloring power and electrical property of the toner.

The coloring pigment may be combined with a resin to become a master batch. Preferably, a toner binder or a resin having a similar structure to the toner binder is used for the mater batch, for improving compatibility with the toner binder, but the resin is not limited thereto.

The master batch may be obtained by mixing and kneading the resin and the coloring pigment while applying a high shearing force thereto. To increase the interaction between the colored pigment and the resin, an organic solvent is preferably added thereto. More specifically, the maser batch may be obtained by a method called flushing in which an aqueous paste of the coloring pigment is mixed and kneaded with the resin and the organic solvent so that the coloring pigment is transferred to the resin side, followed by removal of the organic solvent and moisture. This method is advantageous in that the resulting wet cake of the coloring pigment can be used as it is without being dried. The mixing and kneading may be performed by a high shearing dispersing device such as a three roll mill.

The inventors of the present invention have also found that the glittering pigment particles and the coloring pigment particles are uniformly dispersed in the toner, while in an image formed with the toner on a recording medium, the coloring pigment particles get into between the glittering pigment particles and are concealed with the glittering pigment particles. As a result, the color adjustment function of the coloring pigment is not sufficiently exerted.

To solve this problem, in the toner according to an embodiment of the present invention, 80% or more of the coloring pigment particles are disposed at a position A and 75% or more of the glittering pigment particles are disposed at a position B, wherein the position A and the position B are on a line connecting a center of gravity of the toner as a start point to a surface of the toner as an end point via a center of gravity of each of the coloring pigment particles and glittering pigment particles, and a distance from the start point to the position A is 0.6 times or more a total distance between the start point and the end point and a distance from the start point to the position B is less than 0.6 times the total distance.

By disposing 80% or more of the coloring pigment particles at the position A, the coloring pigment particles are suppressed from being concealed with the glittering pigment particles. Thus, the toner can exhibit vivid glittering color, such as gold color. In addition, by disposing 75% or more of the glittering pigment particles at the position B, deterioration of electric and charge properties, that may be caused by charge leakage from the toner, can be prevented.

More preferably, 90% or more of the coloring pigment particles are disposed at the position A.

In addition, more preferably, 80% or more of the glittering pigment particles are disposed at the position B.

The amount of the coloring pigment particles disposed at the position A and the amount of the glittering pigment particles disposed at the position B are measured as follows.

First, a cross-sectional image of the toner is obtained as follows.

The toner is embedded in an epoxy resin and cut into a thin section having a thickness of about 0.1 to 0.2 μm by a microtome. The thin section is observed with an optical microscope, a fluorescence microscope, or a transmission electron microscope (TEM) to obtain a cross-sectional image of the toner. Alternatively, a cross-sectional image may be obtained by a scanning electron microscope (SEM). In this case, a cross-section of the toner may be prepared by a microtome or an ion milling machine. Examples of preparation conditions are described below.

Microtome: Diamond knife (with an edge angle of 45 degrees)

Optical microscope: For observing transmission image

Fluorescence microscope: For observing florescent image

TEM: For observing transmission image under an acceleration voltage of from 50 to 200 kV SEM: For observing under an acceleration voltage of from 0.8 to 2 kV Ion milling: For preparing cross-section under cooling The amount of the coloring pigment particles disposed at the position A and the amount of the glittering pigment particles disposed at the position B are measured from the above-obtained cross-sectional image of the toner in the following manner. In the present disclosure, a cross-sectional image of the toner is obtained with TEM at a magnification of 10K times under the above-described conditions.

1) Ten toner particles which have a particle diameter D (μm) satisfying the formula $Dv-1\ \mu m \leq D \leq Dv+1\ \mu m$, where Dv (μm) represents the volume average particle diameter of the toner, are extracted and subject to a measurement. The volume average particle diameter Dv can be measured by any known particle size distribution analyzer (such as MULTISIZER).

2) Each toner particle is subjected to a particle analysis using an image analysis and measurement software program (IMAGE-PRO PREMIER available from Media Cybernetics).

3) In the particle analysis, a contour of a toner particle is extracted from a cross-sectional TEM image of the toner particle. A center of gravity of an ellipse having the same area, first moment, and second moment as the toner particle is defined as a center of gravity (GT) of the toner particle, and a coordinate thereof is determined. Voids inside the toner particle, if any, are ignored. The whole toner particle is regarded as uniformly filled with materials.

4) From the cross-sectional TEM image of the toner particle, the coloring pigment (C) particles and the glittering pigment (G) particles are extracted and discriminated by their shape and contrast.

5) A center of gravity (GC) of each coloring pigment (C) particle and a coordinate thereof and a center of gravity (GG) of each glittering pigment (G) particle and a coordinate thereof are determined in the same manner as in the above paragraph 3).

6) The amount of the coloring pigment (C) particles disposed at the position A and the amount of the glittering pigment (G) particles disposed at the position B are determined from their coordinates in the below-described manner.

7) The amount of the coloring pigment (C) particles disposed at the position A and the amount of the glittering pigment (G) particles disposed at the position B are determined for each of the ten toner particles through the above procedures 2) to 6), and the measured values are averaged.

Measurement of Amount of Coloring Pigment Particles Disposed at Position A

A straight line is drawn from the center of gravity (GT) of the toner particle, as a start point, to the center of gravity (GC) of each coloring pigment (C) particle. The position where the extended straight line intersects with the surface (contour) of the toner particle is determined as an end point. A line segment between the start point (i.e., the center of gravity (GT) of the toner particle) and the end point (i.e., the intersection of the straight line with the contour of the toner particle) is defined as a "toner radius" for each coloring pigment (C) particle. The center of gravity (GC) of each coloring pigment (C) particle is always positioned between the start point and the end point. The position of each coloring pigment (C) particle is defined by a ratio of the distance between the center of gravity (GT) of the toner particle and the center of gravity (GC) of the coloring pigment (C) particle to the toner radius. The closer the coloring pigment (C) particle to the center of gravity (GT) of the toner particle, the closer the above-defined ratio to zero. The closer the coloring pigment (C) particle to the contour of the toner particle, the closer the above-defined ratio to one. When 80% or more of the coloring pigment (C) particles are disposed at the position A, it means that the total cross-sectional area of the coloring pigment (C) particles disposed at the position A accounts for 80% by area or more of the total cross-sectional area of all the coloring pigment (C) particles in the cross-sectional TEM image of the toner particle.

Measurement of Amount of Glittering Pigment Particles Disposed at Position B

A straight line is drawn from the center of gravity (GT) of the toner particle, as a start point, to the center of gravity (GG) of each glittering pigment (G) particle. The position where the extended straight line intersects with the surface (contour) of the toner particle is determined as an end point. A line segment between the start point (i.e., the center of gravity (GT) of the toner particle) and the end point (i.e., the intersection of the straight line with the contour of the toner particle) is defined as a "toner radius" for each glittering pigment (G) particle. The center of gravity (GG) of each glittering pigment (G) particle is always positioned between the start point and the end point. The position of each glittering pigment (G) particle is defined by a ratio of the distance between the center of gravity (GT) of the toner particle and the center of gravity (GG) of the glittering pigment (G) particle to the toner radius. The closer the glittering pigment (G) particle to the center of gravity (GT) of the toner particle, the closer the above-defined ratio to zero. The closer the glittering pigment (G) particle to the contour of the toner particle, the closer the above-defined ratio to one. When 75% or more of the glittering pigment (G) particles are disposed at the position B, it means that the total cross-sectional area of the glittering pigment (G) particles disposed at the position B accounts for 75% by area or more of the total cross-sectional area of all the glittering pigment (G) particles in the cross-sectional TEM image of the toner particle.

There is no need to concern that light cannot reach the glittering pigment particles inside the toner particle if a large amount of the coloring pigment particles are present at the surface of the toner particle, since light with a wavelength not within the absorption wavelength range of the coloring pigment generally reach the inside of the toner particle and light with any wavelength can transmit though spaces between the coloring pigment particles.

The above-described disposition of the coloring pigment particles and the glittering pigment particles can be achieved by manufacturing the toner by a method described below.

The toner according to an embodiment of the present invention comprises at least the coloring pigment and the glittering pigment. Preferably, the toner further comprises a wax and a crystalline resin as a binder resin. The toner may further comprise other components, if necessary.

Method of Manufacturing Toner

The toner according to an embodiment of the present invention may be prepared by any known method, such as pulverization methods and polymerization methods.

The toner according to an embodiment of the present invention may comprise a mother particle and an external additive, and the mother particle may be prepared by a dissolution suspension method.

Preferably, the toner may be prepared by a process including dispersing an organic liquid, containing the glittering pigment and the coloring pigment, in an aqueous medium to form an oil-in-water (O/W) emulsion.

In this process, the glittering pigment and the coloring pigment can freely move in oil droplets (i.e., droplets of the organic liquid), and the positions thereof in the toner particle are easily controllable.

Specific preferred examples of such a process include a dissolution suspension method and a suspension polymerization method that uses a radical polymerizable monomer.

The coloring pigment can be disposed near the surface of the toner by controlling polarity and/or wettability (surface energy) of the coloring pigment. In the above-described process in which oil droplets are formed in an aqueous medium, the coloring pigment may be surface-treated with a surface treatment agent, such as a silane coupling agent and a titanate coupling agent, so that the coloring pigment can be disposed at the interface between the oil droplets and the aqueous medium. Alternatively, the surface of the coloring pigment may be covered with a material such as a resin. In this case, specific preferred examples of the covering material include, but are not limited to, rosin resins having a carboxyl group in large amounts, and resins and waxes having a polar group such as ester group.

Dissolution Suspension Method and Suspension Polymerization Method

The dissolution suspension method may include the processes of dissolving or dispersing toner components comprising at least a binder resin or resin precursor, the glittering pigment, the coloring pigment, and a wax in an organic solvent to prepare an oil phase composition, and dispersing or emulsifying the oil phase composition in an aqueous medium, to prepare mother particles of the toner.

Preferably, the organic solvent in which the toner components are dissolved or dispersed is a volatile solvent having a boiling point of less than 100° C., for easy removal of the organic solvent in the succeeding process.

Specific examples of such organic solvents include, but are not limited to, ester-based or ester-ether-based solvents such as ethyl acetate, butyl acetate, methoxybutyl acetate, methyl cellosolve acetate, and ethyl cellosolve acetate; ether-based solvents such as diethyl ether, tetrahydrofuran, dioxane, ethyl cellosolve, butyl cellosolve, and propylene glycol monomethyl ether; ketone-based solvents such as acetone, methyl ethyl ketone, methyl isobutyl ketone, di-n-butyl ketone, and cyclohexanone; alcohol-based solvents such as methanol, ethanol, n-propanol, isopropanol, n-butanol, isobutanol, t-butanol, 2-ethylhexyl alcohol, and benzyl alcohol; and mixtures of two or more of the above solvents.

In the dissolution suspension method, at the time when the oil phase composition is dispersed or emulsified in the aqueous medium, an emulsifier or dispersant may be used, as necessary.

Examples of the emulsifier or dispersant include, but are not limited to, surfactants and water-soluble polymers. Specific examples of the surfactants include, but are not limited to, anionic surfactants (e.g., alkylbenzene sulfonate and phosphate), cationic surfactants (e.g., quaternary ammonium salt type and amine salt type), ampholytic surfactants (e.g., carboxylate type, sulfate salt type, sulfonate type, and phosphate salt type), and nonionic surfactants (e.g., AO-adduct type and polyol type). Each of these surfactants can be used alone or in combination with others.

Specific examples of the water-soluble polymers include, but are not limited to, cellulose compounds (e.g., methyl cellulose, ethyl cellulose, hydroxyethyl cellulose, ethyl hydroxyethyl cellulose, carboxymethyl cellulose, hydroxypropyl cellulose, and saponification products thereof), gelatin, starch, dextrin, gum arabic, chitin, chitosan, polyvinyl alcohol, polyvinylpyrrolidone, polyethylene glycol, polyethyleneimine, polyacrylamide, acrylic-acid-containing or acrylate-containing polymers (e.g., sodium polyacrylate, potassium polyacrylate, ammonium polyacrylate, sodium hydroxide partial neutralization product of polyacrylic acid, and sodium acrylate-acrylate copolymer), sodium hydroxide (partial) neutralization product of styrene-maleic anhydride copolymer, and water-soluble polyurethanes (e.g. reaction product of polyethylene glycol or polycaprolactone with polyisocyanate).

In addition, the above organic solvents and plasticizers may be used in combination as an auxiliary agent for emulsification or dispersion.

Preferably, mother particles of the toner are produced by a dissolution suspension method ("manufacturing method (I)") including the process of dispersing or emulsifying an oil phase composition in an aqueous medium containing resin fine particles, where the oil phase composition contains at least a binder resin, a binder resin precursor having a functional group reactive with an active hydrogen group ("prepolymer having a reactive group"), the glittering pigment, the coloring pigment, and a wax, to allow the prepolymer having a reactive group to react with a compound having an active hydrogen group that is contained in the oil phase composition and/or the aqueous medium.

The resin fine particles may be produced by a known polymerization method, and is preferably obtained in the form of an aqueous dispersion thereof. An aqueous dispersion of resin fine particles may be prepared by, for example, one of the following methods (a) to (h).

(a) Subjecting a vinyl monomer as a starting material to one of suspension polymerization, emulsion polymerization, seed polymerization, and dispersion polymerization, thereby directly preparing an aqueous dispersion of resin fine particles.

(b) Dispersing a precursor (e.g., monomer and oligomer) of a polyaddition or polycondensation resin (e.g., polyester resin, polyurethane resin, and epoxy resin) or a solvent solution thereof in an aqueous medium in the presence of a dispersant, and allowing the precursor to cure by application of heat or addition of a curing agent, thereby preparing an aqueous dispersion of resin fine particles.

(c) Dissolving an emulsifier in a precursor (e.g., monomer and oligomer) of a polyaddition or polycondensation resin (e.g., polyester resin, polyurethane resin, and epoxy resin) or a solvent solution thereof (preferably in a liquid state, may be liquefied by application of heat), and adding water thereto to cause phase-inversion emulsification, thereby preparing an aqueous dispersion of resin fine particles.

(d) Pulverizing a resin produced by a polymerization reaction (e.g., addition polymerization, ring-opening polymerization, polyaddition, addition condensation, and condensation polymerization) into particles by a mechanical rotary pulverizer or a jet pulverizer, classifying the particles by size to collect desired-size particles, and dispersing the collected particles in water in the presence of a dispersant, thereby preparing an aqueous dispersion of resin fine particles.

(e) Spraying a solvent solution of a resin produced by a polymerization reaction (e.g., addition polymerization, ring-opening polymerization, polyaddition, addition condensation, and condensation polymerization) to form resin fine particles, and dispersing the resin fine particles in water in the presence of a dispersant, thereby preparing an aqueous dispersion of resin fine particles.

(f) Adding a poor solvent to a solvent solution of a resin produced by a polymerization reaction (e.g., addition polymerization, ring-opening polymerization, polyaddition, addition condensation, and condensation polymerization), or cooling the solvent solution of the resin in a case in which the resin is dissolved in the solvent by application of heat, to precipitate resin fine particles, removing the solvent to isolate the resin fine particles, and dispersing the resin fine particles in water in the presence of a dispersant, thereby preparing an aqueous dispersion of resin fine particles.

(g) Dispersing a solvent solution of a resin produced by a polymerization reaction (e.g., addition polymerization, ring-opening polymerization, polyaddition, addition condensation, and condensation polymerization) in an aqueous medium in the presence of a dispersant, and removing the solvent by application of heat or reduction of pressure, thereby preparing an aqueous dispersion of resin fine particles.

(h) Dissolving an emulsifier in a solvent solution of a resin produced by a polymerization reaction (e.g., addition polymerization, ring-opening polymerization, polyaddition, addition condensation, and condensation polymerization), and adding water thereto to cause phase-inversion emulsification, thereby preparing an aqueous dispersion of resin fine particles.

The resin fine particles preferably have a volume average particle diameter of from 10 to 300 nm, more preferably from 30 to 120 nm. When the volume average particle diameter of the resin fine particles is less than 10 nm or greater than 300 nm, particle size distribution of the toner may deteriorate.

Preferably, the oil phase has a solid content concentration of about 40% to 80%. When the concentration is too high, the oil phase becomes more difficult to emulsify or disperse in an aqueous medium, or to handle, due to high viscosity. When the concentration is too low, toner productivity decreases.

Toner components other than the binder resin, such as the glittering pigment, the coloring pigment, and the wax, and master batch thereof, may be independently dissolved or dispersed in an organic solvent and thereafter mixed in a solution or dispersion of the binder resin.

The aqueous medium may comprise water alone or a combination of water with a water-miscible solvent. Specific examples of the water-miscible solvent include, but are not limited to, alcohols (e.g., methanol, isopropanol, and ethylene glycol), dimethylformamide, tetrahydrofuran, cellosolves (e.g., methyl cellosolve), and lower ketones (e.g., acetone and methyl ethyl ketone).

The oil phase may be dispersed or emulsified in the aqueous medium by any known dispersing equipment such as a low-speed shearing disperser, high-speed shearing disperser, frictional disperser, high-pressure jet disperser, and ultrasonic disperser. For reducing the particle size of resulting particles, a high-speed shearing disperser is preferable. When a high-speed shearing disperser is used, the revolution is typically from 1,000 to 30,000 rpm, preferably from 5,000 to 20,000 rpm, but is not limited thereto. The dispersing temperature is typically from 0° C. to 150° C. (under pressure) and preferably from 20° C. to 80° C.

The organic solvent may be removed from the resulting emulsion or dispersion by gradually heating the whole system being stirred under normal or reduced pressure to completely evaporate the organic solvent contained in liquid droplets.

Mother toner particles dispersed in the aqueous medium are washed and dried by known methods as follows. First, the dispersion is solid-liquid separated by a centrifugal separator or filter press. The resulting toner cake is redispersed in ion-exchange water having a temperature ranging from noiinal temperature to about 40° C. After optionally adjusting pH by acids and bases, the dispersion is subjected to solid-liquid separation again. These processes are repeated several times to remove impurities and surfactants. The resulting toner cake is then dried by an airflow dryer, circulation dryer, decompression dryer, or vibration fluidizing dryer, thus obtaining toner particles. Undesired ultrafine particles may be removed by a centrifugal separator during the drying process. Alternatively, the particle size distribution may be adjusted by a classifier after the drying process.

The oil phase may also be prepared by replacing the organic solvent with a radical polymerizable monomer and a polymerization initiator. As this oil phase is emulsified and the oil droplets are subjected to a polymerization by application of heat, the toner is prepared by a suspension polymerization method. Specific preferred examples of the radical polymerizable monomer include styrene, acrylate, and methacrylate monomers. The polymerization initiator may be selected from azo initiators or peroxide initiators. The suspension polymerization method needs not include a process for removing organic solvent.

The mother toner particles thus prepared may be mixed with inorganic fine particles, such as hydrophobic silica powder, for improving fluidity, storage stability, developability, and transferability.

The mixing of such external additive may be performed with a typical powder mixer, preferably equipped with a jacket for inner temperature control. To vary load history given to the external additive, the external additive may be gradually added or added from the middle of the mixing, while optionally varying the rotation number, rolling speed, time, and temperature of the mixer. The load may be initially strong and gradually weaken, or vice versa. Specific examples of usable mixers include, but are not limited to, V-type mixer, ROCKING MIXER, LOEDIGE MIXER, NAUTA MIXER, and HENSCHEL MIXER. The mother toner particles are then allowed to pass a sieve having a mesh size of 250 or more so that coarse particles and aggregated particles are removed, thereby obtaining toner particles.

In the dissolution suspension method, resins capable of being dissolved in a solvent may be used. Specific examples of such resins include those conventionally used as toner binder, such as polyester resin, styrene-acrylic resin, polyol resin, vinyl resin, polyurethane resin, epoxy resin, polyamide resin, polyimide resin, silicon-based resin, phenol resin, melamine resin, urea resin, aniline resin, ionomer resin, and polycarbonate resin.

For low-temperature fixability, polyester resin is preferable. Polyester Resin

Specific examples of the polyester resin include, but are not limited to, polycondensation products of a polyol (1) with a polycarboxylic acid (2). Several types of polyester resins may be mixed and used in combination.

Polyol

Specific examples of the polyol (1) include, but are not limited to, alkylene glycols (e.g., ethylene glycol, 1,2-propylene glycol, 1,3-propylene glycol, 1,4-butanediol, and 1,6-hexanediol); alkylene ether glycols (e.g., diethylene glycol, triethylene glycol, dipropylene glycol, polyethylene glycol, polypropylene glycol, and polytetramethylene ether glycol); alicyclic diols (e.g., 1,4-cyclohexanedimethanol and hydrogenated bisphenol A); bisphenols (e.g., bisphenol A, bisphenol F, bisphenol S, and 4,4'-dihydroxybiphenyls such as 3,3'-difluoro-4,4'-dihydroxybiphenyl); bis(hydroxyphenyl)alkanes (e.g., bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (also known as tetrafluorobisphenol A), and 2,2-bis(3-hydroxyphenyl)-1,1,1,3,3,3-hexafluoropropane); bis(4-hydroxyphenyl) ethers (e.g., bis(3-fluoro-4-hydroxyphenyl) ether); and alkylene oxide (e.g., ethylene oxide, propylene oxide, and butylene oxide) adducts of the above-described alicyclic diols; and alkylene oxide (e.g., ethylene oxide, propylene oxide, and butylene oxide) adducts of the above-described bisphenols.

Among these, alkylene glycols having 2 to 12 carbon atoms and alkylene oxide adducts of bisphenols are preferable; and combination use of alkylene oxide adducts of bisphenols with alkylene glycols having 2 to 12 carbon atoms is more preferable.

Specific examples of the polyol (1) further include, but are not limited to, polyvalent aliphatic alcohols having 3 to 8 valences or more (e.g., glycerin, trimethylolethane, trimethylolpropane, pentaerythritol, and sorbitol); phenols having 3 or more valences (e.g., trisphenol PA, phenol novolac, and cresol novolac); and alkylene oxide adducts of the polyphenols having 3 or more valences.

Each of the above-described polyols (1) may be used alone or in combination with others.

Polycarboxylic Acid

Specific examples of the polycarboxylic acid (2) include, but are not limited to, alkylene dicarboxylic acids (e.g., succinic acid, adipic acid, and sebacic acid), alkenylene dicarboxylic acids (e.g., maleic acid and fumaric acid), aromatic dicarboxylic acids (e.g., phthalic acid, isophthalic acid, terephthalic acid, and naphthalenedicarboxylic acid), 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl)hexafluoropropane, 2,2-bis (3-carboxyphenyl)hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid, and hexafluoroisopropylidene diphthalic acid anhydride.

Among these, alkenylene dicarboxylic acids having 4 to 20 carbon atoms and aromatic dicarboxylic acids having 8 to 20 carbon atoms are preferable. Specific examples of the polycarboxylic acid (2) to be reacted with the polyol (1) further include, but are not limited to, polycarboxylic acids having 3 or more valences such as aromatic polycarboxylic acids having 9 to 20 carbon atoms (e.g., trimellitic acid and pyromellitic acid); and acid anhydrides or lower alkyl esters (e.g., methyl ester, ethyl ester, and isopropyl ester) of the above-described compounds.

Each of the above-described polycarboxylic acids (2) may be used alone or in combination with others.

Ratio Between Polyol and Polycarboxylic Acid

The equivalent ratio [OH]/[COOH] of hydroxyl groups [OH] in the polyol (1) to carboxyl groups [COOH] in the polycarboxylic acid (2) is typically from 2/1 to 1/1, preferably from 1.5/1 to 1/1, and more preferably from 1.3/1 to 1.02/1.

Modified Polyester Resin

The toner according to an embodiment of the present invention may further comprise a binder resin. The binder resin may comprise a polyester resin modified with a urethane and/or urea group (hereinafter "modified polyester resin") for adjusting viscoelasticity.

Preferably, the content of the modified polyester resin having a urethane and/or urea group is 20% by weight or less, more preferably 15% by weight or less, most preferably 10% by weight or less, based on a total weight of the binder resin. When the content exceeds 20% by weight, low-temperature fixability may deteriorate.

The modified polyester resin having a urethane and/or urea group may be directly mixed in the binder resin. More preferably, the modified polyester resin having a urethane and/or urea group may be produced by causing a chain extension and/or cross-linking reaction between a prepolymer which has an isocyanate group on its terminal and a relatively low molecular weight, and an amine which is reactive with the prepolymer, in the binder resin, during or after granulation. This is an easy way to include a modified polyester resin having a relatively high molecular weight in the toner, for adjusting viscoelasticity.

Prepolymer

The prepolymer having an isocyanate group may be a reaction product of a polyester having an active hydrogen group, that is a polycondensation product of the polyol (1) with the polycarboxylic acid (2), with a polyisocyanate (3). The active hydrogen group in the polyester may be, for example, hydroxyl group (e.g., alcoholic hydroxyl group and phenolic hydroxyl group), amino group, carboxyl group, or mercapto group. Among these groups, alcoholic hydroxyl group is most preferable.

Polyisocyanate

Specific examples of the polyisocyanate (3) include, but are not limited to, aliphatic polyisocyanates (e.g., tetramethylene diisocyanate, hexamethylene diisocyanate, and 2,6-diisocyanatomethyl caproate), alicyclic polyisocyanates (e.g., isophorone diisocyanate and cyclohexylmethane diisocyanate), aromatic diisocyanates (e.g., tolylene diisocyanate and diphenylmethane diisocyanate), aromatic aliphatic diisocyanates (e.g., α,α,α',α'-tetramethylxylylene diisocyanate), isocyanurates, and the above polyisocyanates blocked with a phenol derivative, an oxime, or caprolactam. Two or more of these compounds can be used in combination.

Ratio Between Isocyanate Group and Hydroxyl Group

The equivalent ratio [NCO]/[OH] of isocyanate groups [NCO] in the polyisocyanate (3) to hydroxyl groups [OH] in the polyester having a hydroxyl group is typically from 5/1 to 1/1, preferably from 4/1 to 1.2/1, and more preferably from 2.5/1 to 1.5/1. When the equivalent ratio [NCO]/[OH] exceeds 5, low-temperature fixability may deteriorate. When the molar ratio of [NCO] is less than 1, the urea content in the modified polyester is lowered and hot offset resistance is thereby degraded.

The content of the polyisocyanate (3) in the prepolymer having an isocyanate group on its terminal is typically from 0.5 to 40% by mass, preferably from 1 to 30% by mass, and more preferably from 2 to 20% by mass. When the content is less than 0.5% by mass, offset resistance may deteriorate. When the content is in excess of 40% by mass, low-temperature fixability may deteriorate.

Number of Isocyanate Groups in Prepolymer

The number of isocyanate groups included in one molecule of the prepolymer having an isocyanate group is typically 1 or more, preferably from 1.5 to 3 in average, and more preferably from 1.8 to 2.5 in average. When the number of isocyanate groups per molecule is less than 1, the molecular weight of the modified polyester after the chain extension and/or cross-linking reaction may be lowered and hot offset resistance may degrade.

Crystalline Resin

The toner according to an embodiment of the present invention may comprise a crystalline resin. Specific preferred examples of the crystalline resin include, but are not limited to, polyester resin prepared from a diol component and a dicarboxylic acid component, ring-opened polymer of lactone, and polymer of polyhydroxycarboxylic acid. Specific preferred examples of the crystalline resin further include urethane-modified polyester resin, urea-modified polyester resin, polyurethane resin, and polyurea resin, each of which having urethane bond and/or urea bond. Among these, urethane-modified polyester resin and urea-modified polyester resin are preferable because they exhibit a high degree of hardness while maintaining crystallinity of the resin.

Urethane-Modified Polyester Resin

The urethane-modified polyester resin may be obtained by a reaction between a polyester resin and an isocyanate component having 2 or more valences, or a reaction between a polyester resin having an isocyanate group on its terminal and a polyol component.

Examples of the polyester resin include polycondensed polyester resin obtained by a polycondensation of a diol component with a dicarboxylic acid component, ring-opened polymer of lactone, and polyhydroxycarboxylic acid. Among these, polycondensed polyester resin obtained by a polycondensation of a diol component with a dicarboxylic acid component is preferable for exhibiting crystallinity.

Diol Component

Preferred examples of the diol component include aliphatic diols, preferably having 2 to 36 carbon atoms in the main chain. Aliphatic diols are of straight-chain type or branched type. In particular, straight-chain aliphatic diols are preferable, and straight-chain aliphatic diols having 4 to 6 carbon atoms are more preferable. The diol component may comprise multiple types of diols. Preferably, the content rate of the straight-chain aliphatic diol in the total diol component is 80% by mol or more, more preferably 90% by mol or more. When the content rate is 80% by mol or more, crystallinity of the resin improves, low-temperature fixability and heat-resistant storage stability go together, and hardness of the resin improves, which is advantageous.

Specific examples of the straight-chain aliphatic diol include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,15-pentadecanediol, 1,16-hexadecanediol, 1,17-heptadecanediol, 1,18-octadecanediol, and 1,20-eicosanediol. Among these, ethylene glycol, 1,3-propanediol, 1,4-butanediol, 1,6-hexanediol, 1,9-nonanediol, and 1,10-decanediol are preferable because they are readily available; and 1,4-butanediol and 1,6-hexanediol are more preferable.

Specific examples of other diols to be used as necessary include, but are not limited to, aliphatic diols having 2 to 36 carbon atoms (e.g., 1,2-propylene glycol, 1,3-butanediol, hexanediol, octanediol, decanediol, dodecanediol, tetradecanediol, neopentyl glycol, and 2,2-diethyl-1,3-propanediol) other than the above-described diols; alkylene ether glycols having 4 to 36 carbon atoms (e.g., diethylene glycol, triethylene glycol, dipropylene glycol, polyethylene glycol, polypropylene glycol, and polytetramethylene ether glycol); alicyclic diols having 4 to 36 carbon atoms (e.g., 1,4-cyclohexanedimethanol and hydrogenated bisphenol A); alkylene oxide ("AO") (e.g., ethylene oxide ("EO"), propylene oxide ("PO"), and butylene oxide ("BO")) adducts (with an adduct molar number of from 1 to 30) of the alicyclic diols; AO (e.g., EU, PO, and BO) adducts (with an adduct molar number of from 2 to 30) of bisphenols (e.g., bisphenol A, bisphenol F, and bisphenol S); polylactone diols (e.g., poly-ε-caprolactone diol); and polybutadiene diols.

Specific examples of alcohols having 3 to 8 or more valences to be used as necessary include, but are not limited to, polyvalent aliphatic alcohols having 3 to 36 carbon atoms and 3 to 8 or more valences (e.g., alkane polyols and intramolecular or intermolecular dehydration product thereof, such as glycerin, trimethylolethane, trimethylolpropane, pentaerythritol, sorbitol, sorbitan, and polyglycerin); sugars and derivatives thereof (e.g., sucrose and methyl glucoside); AO adduct (with an adduct molar number of from 2 to 30) of trisphenols (e.g., trisphenol PA); AO adduct (with an adduct molar number of from 2 to 30) of novolac resins (e.g., phenol novolac and cresol novolac); and acrylic polyols (e.g., copolymer of hydroxyethyl (meth)acrylate and other vinyl monomer). Among these, polyvalent aliphatic alcohols having 3 to 8 or more valences and AO adducts of novolac resins are preferable; and AO adducts of novolac resin are more preferable.

Dicarboxylic Acid Component

Preferred examples of the dicarboxylic acid component include aliphatic dicarboxylic acids and aromatic dicarboxylic acids. Aliphatic dicarboxylic acids are of straight-chain type or branched type. In particular, straight-chain dicarboxylic acids are preferable. Among straight chain dicarboxylic acids, saturated aliphatic dicarboxylic acids having 6 to 12 carbon atoms are particularly preferable.

Specific examples of the dicarboxylic acids include, but are not limited to, alkanedicarboxylic acids having 4 to 36 carbon atoms (e.g., succinic acid, adipic acid, azelaic acid, sebacic acid, dodecanedioic acid, tetradecanedioic acid, hexadecanedioic acid, and octadecanedioic acid); alicyclic dicarboxylic acids having 6 to 40 carbon atoms (e.g., dimmer acids such as dimerized linoleic acid); alkenedicarboxylic acids having 4 to 36 carbon atoms (e.g., alkenyl succinic acids such as dodecenyl succinic acid, pentadecenyl succinic acid, and octadecenyl succinic acid; and maleic acid, fumaric acid, and citraconic acid); and aromatic dicarboxylic acids having 8 to 36 carbon atoms (e.g., phthalic acid, isophthalic acid, terephthalic acid, t-butyl isophthalic acid, 2,6-naphthalenedicarboxylic acid, and 4,4'-biphenyl dicarboxylic acid).

Specific examples of polycarboxylic acids having 3 to 6 or more valences to be used as necessary include, but are not limited to, aromatic polycarboxylic acids having 9 to 20 carbon atoms (e.g., trimellitic acid and pyromellitic acid).

Additionally, acid anhydrides and C1-C4 lower alkyl esters (e.g., methyl ester, ethyl ester, and isopropyl ester) of the above-described dicarboxylic acids and polycarboxylic acids having 3 to 6 or more valences may also be used.

Among the above dicarboxylic acids, it is preferable that one type of the aliphatic dicarboxylic acid (preferably, adipic acid, sebacic acid, or dodecanedioic acid) is used alone or in combination with others. In addition, a copolymer of an aliphatic dicarboxylic acid with an aromatic dicarboxylic acid (preferably, terephthalic acid, isophthalic acid, t-butyl isophthalic acid, or a lower alkyl ester thereof) is also preferable. The content rate of the aromatic dicarboxylic acid in the copolymer is preferably 20% by mol or less.

Ring-Opened Polymer of Lactone

The ring-opened polymer of lactone, serving as the polyester resin, may be obtained by a ring-opening polymerization of lactones (e.g., monolactones (having one ester group in the ring) having 3 to 12 carbon atoms, such as β-propiolactone, γ-butyrolactone, δ-valerolactone, and ε-caprolactone) in the presence of a catalyst (e.g., metal oxide and organic metallic compound.) Among the above lactones, ε-caprolactone is preferable for crystallinity.

The ring-opened polymer of lactone may be obtained by a ring-opening polymerization of the above lactone with the use of a glycol (e.g., ethylene glycol and diethylene glycol) as an initiator, so that hydroxyl group is introduced to a terminal. The terminal hydroxyl group may be further modified into carboxyl group. Additionally, commercially-available products of the ring-opened polymer of lactone may also be used, such as PLACCEL series H1P, H4, H5, and H7 from DAICEL CORPORATION, which are high crystallinity polycaprolactones.

Polyhydroxycarboxylic Acid

The polyhydroxycarboxylic acid, serving as the polyester resin, may be directly obtained by a dehydration condensation of a hydroxycarboxylic acid such as glycolic acid and lactic acid (in L-form, D-form, or racemic form). However, the polyhydroxycarboxylic acid is preferably obtained by a ring-opening polymerization of a cyclic ester (having 2 to 3 ester groups in the ring) having 4 to 12 carbon atoms, that is a product of an intermolecular dehydration condensation among two or three molecules of a hydroxycarboxylic acid such as glycolic acid and lactic acid (in L-form, D-form, or racemic form), in the presence of a catalyst (e.g., metal oxide and organic metallic compound), for adjusting molecular weight. Preferred examples of the cyclic ester include L-lactide and D-lactide for crystallinity. The polyhydroxycarboxylic acid may be modified such that hydroxyl group or carboxyl group is introduced to a terminal.

Isocyanate Component Having 2 or More Valences

Examples of the isocyanate component include aromatic isocyanates, aliphatic isocyanates, alicyclic isocyanates, and aromatic aliphatic isocyanates. Preferred examples of the isocyanate component include: aromatic diisocyanates having 6 to 20 carbon atoms, aliphatic diisocyanates having 2 to 18 carbon atoms, alicyclic diisocyanates having 4 to 15 carbon atoms, and aromatic aliphatic diisocyanates having 8 to 15 carbon atoms (here, the number of carbon atoms in NCO groups are excluded); modified products of these diisocyanates (e.g., modified products having urethane group, carbodiimide group, allophanate group, urea group, biuret group, uretdione group, uretonimine group, isocyanurate group, or oxazolidone group); and mixtures of two or more of these compounds. An isocyanate having 3 or more valences may be used in combination as necessary.

Specific examples of the aromatic isocyanates include, but are not limited to, 1,3-phenylene diisocyanate, 1,4-phenylene diisocyanate, 2,4-tolylene diisocyanate (TDI), 2,6-tolylene diisocyanate (TDI), crude TDI, 2,4'-diphenylmethane diisocyanate (MDI), 4,4'-diphenylmethane diisocyanate (MDI), crude MDI [also known as polyallyl polyisocyanate (DAPI), that is a phosgenation product of crude diaminophenylmethane (that is a condensation product of formaldehyde with an aromatic amine (e.g., aniline) or mixture thereof, where the "an aromatic amine (e.g., aniline) or mixture thereof" includes a mixture of diaminodiphenylmethane with a small amount (e.g., 5 to 20% by mass) of a polyamine having 3 or more functional groups)], 1,5-naphthylene diisocyanate, 4,4',4"-triphenylmethane triisocyanate, m-isocyanatophenylsulfonyl isocyanate, and p-isocyanatophenylsulfonyl isocyanate.

Specific examples of the aliphatic isocyanates include, but are not limited to, ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl) fumarate, bis(2-isocyanatoethyl) carbonate, and 2-isocyanatoethyl-2,6-diisocyanatohexanoate.

Specific examples of the alicyclic isocyanates include, but are not limited to, isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5-norbornane diisocyanate, and 2,6-norbornane diisocyanate.

Specific examples of the aromatic aliphatic isocyanates include, but are not limited to, m-xylylene diisocyanate (XDI), p-xylylene diisocyanate (XDI), and $\alpha,\alpha,\alpha',\alpha'$-tetramethylxylylene diisocyanate (TMXDI).

The modified products of the diisocyanates include those having urethane group, carbodiimide group, allophanate group, urea group, biuret group, uretdione group, uretonimine group, isocyanurate group, or oxazolidone group. Specifically, examples of the modified products of the diisocyanates include, but are not limited to, modified MDI (e.g., urethane-modified MDI, carbodiimide-modified MDI, and trihydrocarbyl-phosphate-modified MDI), urethane-modified TDI, and mixtures of two or more of these compounds (e.g., a combination of modified MDI and urethane-modified TDI (i.e., a prepolymer having an isocyanate group)).

Among these compounds, preferred are aromatic diisocyanates having 6 to 15 carbon atoms, aliphatic diisocyanates having 4 to 12 carbon atoms, alicyclic diisocyanates having 4 to 15 carbon atoms (here, the number of carbon atoms in NCO groups are excluded); and more preferred are TDI, MDI, HDI, hydrogenated MDI, and IPDI.

Urea-Modified Polyester Resin

The urea-modified polyester resin may be obtained by a reaction between a polyester resin having an isocyanate group on its terminal and an amine compound.

Amine Component Having 2 or More Valences

Examples of the amine component include aliphatic amines and aromatic amines. Preferred examples of the amine component include aliphatic diamines having 2 to 18 carbon atoms and aromatic diamines having 6 to 20 carbon atoms. An amine having 3 or more valences may be used in combination as necessary.

Specific examples of the aliphatic diamines having 2 to 18 carbon atoms include, but are not limited to: alkylene diamines having 2 to 6 carbon atoms (e.g., ethylenediamine, propylenediamine, trimethylenediamine, tetramethylenediamine, and hexamethylenediamine); polyalkylene diamines having 4 to 18 carbon atoms (e.g., diethylenetriamine, iminobispropylamine, bis(hexamethylene)triamine, triethylenetetramine, tetraethylenepentamine, and pentaethylenehexamine); C1-C4 alkyl or C2-C4 hydroxyalkyl substitutes of the above compounds (e.g., dialkylaminopropylamine, trimethylhexamethylenediamine, aminoethylethanolamine, 2,5-dimethyl-2,5-hexamethylenediamine, and methyliminobispropylamine); alicyclic or heterocyclic aliphatic diamines (e.g., alicyclic diamines having 4 to 15 carbon atoms, such as 1,3-diaminocyclohexane, isophoronediamine, mentheneediamine, and 4,4'-methylenedicyclohexanediamine (hydrogenated methylenedianiline); and heterocyclic diamines having 4 to 15 carbon atoms, such as piperazine, N-aminoethylpiperazine, 1,4-diaminoethylpiperazine, 1,4-bis(2-amino-2-methylpropyl)piperazine, and 3,9-bis(3-aminopropyl)-2,4,8,10-tetraoxaspiro[5,5]undecane); and aromatic aliphatic amines having 8 to 15 carbon atoms (e.g., xylylenediamine and tetrachloro-p-xylylenediamine).

Specific examples of the aromatic diamines having 6 to 20 carbon atoms include, but are not limited to: unsubstituted aromatic diamines (e.g., 1,2-phenylenediamine, 1,3-phenylenediamine, 1,4-phenylenediamine, 2,4'-diphenylmethanediamine, 4,4'-diphenylmethanediamine, crude diphenylmethanediamine(polyphenyl polymethylene polyamine), diaminodiphenyl sulfone, benzidine, thiodianiline, bis(3,4-diaminophenyl) sulfone, 2,6-diaminopyridine, m-aminobenzylamine, triphenylmethane-4,4',4"-triamine, and naphthylenediamine); aromatic diamines having a nuclear-substituted alkyl group having 1 to 4 carbon atoms (e.g., 2,4-tolylenediamine, 2,6-tolylenediamine, crude tolylenediamine, diethyltolylenediamine, 4,4'-diamino-3,3'-dimethyldiphenylmethane, 4,4'-bis(o-toluidine), dianisidine, diaminoditolyl sulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenylmethane, 3,5-diethyl-3'-methyl-2',4-diaminodiphenylmethane, 3,3'-diethyl-2,2'-diaminodiphenylmethane, 4,4'-diamino-3,3'-dimethyldiphenylmethane, 3,3',5,5'-tetraethyl-4,4'-diaminobenzophenone, 3,3',5,5'-tetraethyl-4,4'-diaminodiphenyl ether, and 3,3',5,5'-tetraisopropyl-4,4'-diaminodiphenyl sulfone) and mixtures of isomers thereof at various mixing ratios; aromatic diamines having a nuclear-substituted electron withdrawing group (e.g., halogen group such as Cl, Br, I, and F; alkoxy group such as methoxy group and ethoxy group; and nitro group), such as methylenebis-o-chloroaniline, 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine, 3-dimethoxy-4-aminoaniline, 4,4'-diamino-3,3'-dimethyl-5,5'-dibromo-diphenylmethane, 3,3'-dichlorobenzidine, 3,3'-dimethoxybenzidine, bis(4-amino-3-chlorophenyl) oxide, bis(4-amino-2-chlorophenyepropane, bis(4-amino-2-chlorophenyl) sulfone, bis(4-amino-3-methoxyphenyl)decane, bis(4-aminophenyl) sulfide, bis(4-aminophenyl) telluride, bis(4-aminophenyl) selenide, bis(4-amino-3-methoxyphenyl) disulfide, 4,4'-methylenebis(2-iodoaniline), 4,4'-methylenebis(2-bromoaniline), 4,4'-methylenebis(2-fluoroaniline), and 4-aminophenyl-2-chloroaniline); and aromatic diamines having a secondary amino group (i.e., the above unsubstituted aromatic diamines, aromatic diamines having a nuclear-substituted alkyl group having 1 to 4 carbon atoms and mixtures of isomers thereof at various mixing ratios, and aromatic diamines having a nuclear-substituted electron withdrawing group, in which part or all of primary amino groups are substituted with a secondary amino group with a lower alkyl group (e.g., methyl grup and ethyl group), such as 4,4'-di (methylamino)diphenylmethane and 1-methyl-2-methyl-amino-4-aminobenzene).

Specific examples of the amines having 3 or more valences include, but are not limited to, polyamide polyamines (such as low-molecular-weight polyamine polyamine obtainable by a condensation between a dicarboxylic acid (e.g., dimer acid) and an excessive amount (i.e., 2 mol or more per 1 mol of acid) of a polyamine (e.g., alkylenediamine and polyalkylene polyamine)) and polyether polyamines (such as hydrides of cyanoethylation products of polyether polyol (e.g., polyalkylene glycol)).

Polyurethane Resin

Examples of the polyurethane resin include polyurethane resins obtained from a diol component and a diisocyanate component. An alcohol component having 3 or more valences and an isocyanate component may be used in combination as necessary.

Specific examples of the diol component, diisocyanate component, alcohol component having 3 or more valences, and isocyanate component include those exemplified above.

Polyurea Resin

Examples of the polyurea resin include polyurea resins obtained from a diamine component and a diisocyanate component. An amine component having 3 or more valences and an isocyanate component may be used in combination as necessary.

Specific examples of the diamine component, diisocyanate component, amine component having 3 or more valences, and isocyanate component include those exemplified above.

Properties of Crystalline Resin

The largest peak temperature of melting heat of the crystalline resin is preferably from 45° C. to 70° C., more preferably from 53° C. to 65° C., and most preferably from 58° C. to 62° C., for achieving both low-temperature fixability and heat-resistant storage stability. When the largest peak temperature is lower than 45° C., low-temperature fixability may improve but heat-resistant storage stability may deteriorate. Undesirably, aggregation of toner and carrier may be easily generated under stirring stress in the developing device. When the the largest peak temperature is higher than 70° C., by contrast, heat-resistant storage stability may improve but low-temperature fixability may deteriorate.

The ratio of the softening temperature to the largest peak temperature of melting heat of the crystalline resin is preferably from 0.80 to 1.55, more preferably from 0.85 to 1.25, much more preferably from 0.90 to 1.20, and most preferably from 0.90 to 1.19. The closer to 1.00 this ratio becomes, the more rapidly the resin softens, which is advantageous for achieving both low-temperature fixability and heat-resistant storage stability.

The crystalline resin preferably has a weight average molecular weight (Mw) of from 10,000 to 40,000, more preferably from 15,000 to 35,000, and most preferably from 20,000 to 30,000, for achieving both low-temperature fixability and heat-resistant storage stability. When Mw is smaller than 10,000, heat-resistant storage stability of the toner may deteriorate. When Mw is larger than 40,000, low-temperature fixability may deteriorate.

The weight average molecular weight (Mw) of resin can be measured by a gel permeation chromatographic ("GPC") instrument (such as HLC-8220 GPC available from Tosoh Corporation). As columns, TSKgel SuperHZM-H 15 cm in 3-tandem (available from Tosoh Corporation) may be used. A resin to be measured is dissolved in tetrahydrofuran ("THF" containing a stabilizer, available from Wako Pure Chemical Industries, Ltd.) to prepare a 0.15 wt % solution thereof. The solution is filtered with a 0.2-μm filter and the filtrate is used as a sample in succeeding procedures. Next, 100 μl of the sample (i.e., THF solution of the resin) is injected into the instrument and subjected to a measurement at 40° C. and a flow rate of 0.35 ml/min. The molecular weight of the sample is determined by comparing the molecular weight distribution of the sample with a calibration curve, compiled with several types of monodisperse polystyrene standard samples, that shows the relation between the logarithmic values of molecular weights and the number of counts. The standard polystyrene samples used to create the calibration curve include SHOWDEX STANDARD Std. No. S-7300, S-210, S-390, S-875, S-1980, S-10.9, S-629, S-3.0, and S-0.580 available from Showa Denko K.K. and toluene. As the detector, an RI (refractive index) detector is used.

The crystalline resin may be a block resin having a crystalline unit and a non-crystalline unit. The crystalline unit may comprise the above-described crystalline resin. The non-crystalline resin unit may comprise polyester resin, polyurethane resin, and/or polyurea resin, but is not limited thereto. The composition of the non-crystalline unit may be similar to that of the crystalline resin. Specific examples of monomers for forming the non-crystalline unit include the above-exemplified diol components, dicarboxylic acid components, diisocyanate components, diamine components, and combinations thereof, but are not limited thereto.

The crystalline resin may be produced by causing a reaction of a crystalline resin precursor having a terminal functional group reactive with an active hydrogen group with a resin or compound (e.g., cross-linking agent and elongating agent) having an active hydrogen group, to thereby increase the molecular weight of the crystalline resin precursor, during the process of producing the toner. The crystalline resin precursor may be obtained by a reaction of a crystalline polyester resin, urethane-modified crystalline polyester resin, urea-modified crystalline polyester resin, crystalline polyurethane resin, or crystalline polyurea resin with a compound having a functional group reactive with an active hydrogen group.

Specific examples of the functional group reactive with an active hydrogen group include, but are not limited to, isocyanate group, epoxy group, carboxylic acid group, and an acid chloride group. Among these, isocyanate group is preferable for reactivity and safety. Specific examples of the compound having an isocyanate group include, but are not limited to, the above-described diisocyanate components.

In a case in which the crystalline resin precursor is obtained by a reaction between a crystalline polyester resin and the diisocyanate component, the crystalline polyester resin preferably has hydroxyl group on its terminal.

The crystalline polyester resin having hydroxyl group may be obtained by a reaction between a diol component and a dicarboxylic acid, where the equivalent ratio [OH]/[COOH] of hydroxyl groups [OH] from the diol component to carboxyl groups [COOH] from the dicarboxylic acid component is preferably from 2/1 to 1/1, more preferably from 1.5/1 to 1/1, and most preferably from 1.3/1 to 1.02/1.

With regard to the use amount of the compound having a functional group reactive with an active hydrogen group, in a case in which the crystalline polyester resin precursor is obtained by a reaction between the crystalline polyester resin having hydroxyl group with the diisocyanate component, the equivalent ratio [NCO]/[OH] of isocyanate groups [NCO] from the diisocyanate component to hydroxyl groups [OH] from the crystalline polyester resin having hydroxyl group is preferably from 5/1 to 1/1, more preferably from 4/1 to 1.2/1, and most preferably from 2.5/1 to 1.5/1. This ratio is unchanged, although the structural components may be varied, even when the crystalline resin precursor has another type of skeleton or terminal group.

The resin or compound (e.g., cross-linking agent and elongating agent) having an active hydrogen group is not limited to any particular material so long as having an active hydrogen group. In a case in which the functional group reactive with an active hydrogen group is an isocyanate group, resins and compounds having hydroxyl group (e.g., alcoholic hydroxyl group and phenolic hydroxyl group), amino group, carboxyl group, or mercapto group are preferable. In particular, water and amines are preferable in view of reaction speed.

Specific examples of the amines include, but are not limited to phenylenediamine, diethyltoluenediamine, 4,4'-diaminodiphenylmethane, 4,4'-diamino-3,3'-dimethyldicyclohexylmethane, diaminocyclohexane, isophoronediamine, ethylenediamine, tetramethylenediamine, hexamethylenediamine, diethylenetriamine, triethylenetetramine, ethanolamine, hydroxyethylaniline, aminoethyl mercaptan, aminopropyl mercaptan, aminopropionic acid, and aminocaproic acid. In addition, ketimine compounds obtained by blocking amino group in the above-described compounds with ketones (e.g., acetone, methyl ethyl ketone, methyl isobutyl ketone), and oxazoline compounds, may also be used.

Wax

The toner according to an embodiment of the present invention may comprise a wax. Examples of the wax include, but are not limited to, polyalkanoic acid ester, polyalkanol ester, polyalkanoic acid amide, polyalkyl amide, and dialkyl ketone.

Specific examples of the polyalkanoic acid ester wax include, but are not limited to, carnauba wax, montan wax, trimethylolpropane tribehenate, pentaerythritol tetrabehenate, pentaerythritol diacetate dibehenate, glycerin tribehenate, and 1,18-octadecanediol distearate.

Specific examples of the polyalkanol ester include, but are not limited to, tristearyl trimellitate and distearyl maleate.

Specific examples of the polyalkanoic acid amide include, but are not limited to, dibehenylamide.

Specific examples of the polyalkyl amide include, but are not limited to, trimellitic acid tristearylamide.

Specific examples of the dialkyl ketone include, but are not limited to, distearyl ketone.

Among these carbonyl-group-containing waxes, polyalkanoic acid ester is preferable.

Preferably, the wax has a branched structure or a polar group so as to have a certain degree of polarity. Such a wax may serve as a needle-like substance that prevents stacking of the glittering pigment particles or widens the distance between the planes of the glittering pigment particles. The melting point of the wax may be the same level as the melting temperature of the binder resin of the toner, or may be higher than the melting temperature thereof as long as being equal to or lower than the temperature of an image being fixed on a paper sheet.

Examples of such waxes include modified waxes to which a polar group, such as hydroxyl group, carboxyl group, amide group, and amino group, is introduced. Examples thereof further include oxidization-modified waxes prepared by oxidizing hydrocarbon by an air oxidization process and metal salts (e.g., potassium salt and sodium salt) thereof; acid-group-containing polymers (e.g., maleic anhydride copolymer and alpha-olefin copolymer) and salts thereof; and alkoxylated products of hydrocarbons modified with imide ester, quaternary amine salt, or hydroxyl group.

In addition, esterification products of the carbonyl-group-containing waxes, such as polyalkanoic acid ester, polyalkanol ester, polyalkanoic acid amide, polyalkyl amide, and dialkyl ketone, may also be used.

Polyolefin waxes, such as polyethylene wax and propylene wax, may also be used.

Long-chain hydrocarbon waxes, such as paraffin wax and SASOL wax, may also be used.

Preferably, the melting point of the wax is from 50° C. to 100° C., more preferably from 60° C. to 90° C. When the melting point is less than 50° C., heat-resistant storage stability may be adversely affected. When the melting point is in excess of 100° C., cold offset is likely to occur in low-temperature fixing.

The melting point of the wax can be measured by a differential scanning calorimeter (TA-60WS and DSC-60 available from Shimadzu Corporation) as follows. First, about 5.0 mg of a wax is put in an aluminum sample container. The sample container is put on a holder unit and set in an electric furnace. In nitrogen atmosphere, the sample is heated from 0° C. to 150° C. at a temperature rising rate of 10° C./min, cooled from 150° C. to 0° C. at a temperature falling rate of 10° C./min, and reheated to 150° C. at a temperature rising rate of 10° C./min, thus obtaining a DSC curve. The DSC curve is analyzed with analysis program installed in DSC-60, and the temperature at the largest peak of melting heat in the second heating is determined as the melting point.

Preferably, the melt viscosity of the wax is from 5 to 100 mPa·sec, more preferably from 5 to 50 mPa·sec, most preferably from 5 to 20 mPa·sec, at 100° C. When the melt viscosity is less than 5 mPa·sec, releasability may deteriorate. When the melt viscosity is larger than 100 mPa·sec, hot offset resistance and low-temperature releasability may deteriorate.

Preferably, the total content of the wax having a needle-like shape and other waxes in the toner is from 1% to 30% by mass, more preferably from 5% to 10% by mass, based on the total mass of the toner. When the content is less than 5% by mass, hot offset resistance may deteriorate. When the content is larger than 10% by mass, heat-resistant storage stability, chargeability, transferability, and stress resistance may deteriorate.

Preferably, the content of the wax serving as a needle-like substance is from 1% to 30% by mass, more preferably from 5% to 10% by mass, based on the mass of the glittering pigment.

External Additive

Examples of the external additive include, but are not limited to, fine inorganic particles. Preferably, the primary particle diameters of the fine inorganic particles range from 5 nm to 2 μm, more preferably from 5 to 500 nm. Preferably, the BET specific surface areas thereof range from 20 to 500 $m^2/g$. Preferably, the content of the fine inorganic particles is from 0.01% to 5% by weight, more preferably from 0.01% to 2.0% by weight, based on the weight of the toner.

Specific examples of the fine inorganic particles include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride.

Developer

The developer according to an embodiment of the present invention comprises at least the above-described toner and optionally other components such as a carrier.

Carrier

The carrier preferably comprises a core material and a protective layer that covers the core material.

Core Material of Carrier

The core material comprises a magnetic particle. Specific preferred examples thereof include ferrite, magnetite, iron, and nickel. In consideration of environmental adaptability that has been remarkably advanced in recent years, manganese ferrite, manganese-magnesium ferrite, manganese-strontium ferrite, manganese-magnesium-strontium ferrite, and lithium ferrite are preferred rather than copper-zinc ferrite that has been conventionally used.

Protective Layer

The protective layer comprises at least a binder resin and optionally other components such as fine inorganic particles.

Binder Resin

The binder resin used for the protective layer of the carrier is not limited to any particular material. Specific examples thereof include, but are not limited to: polyolefins (e.g., polyethylene and polypropylene) and modification products thereof; styrene acrylic resins; cross-linked copolymers containing acrylonitrile, vinyl acetate, vinyl alcohol, vinyl chloride, vinyl carbazole, and/or vinyl ether; silicone resins comprising organosiloxane bonds and modification products thereof (e.g., modified with alkyd resin, polyester resin, epoxy resin, polyurethane, or polyimide); polyamide; polyester; polyurethane; polycarbonate; urea resins; melamine resins; benzoguanamine resins; epoxy resins; ionomer resins; polyimide resins; and derivatives thereof. Each of these materials can be used alone or in combination with others. Among these materials, silicone resins are preferable.

Specific examples of the silicone resins include, but are not limited to, straight silicone resins consisting of organosiloxane bonds and modified silicone resins modified with alkyd, polyester, epoxy, acrylic polymer, or urethane.

Specific examples of the straight silicone resins include, but are not limited to: KR271, KR272, KR282, KR252, KR255, and KR152 (available from Shin-Etsu Chemical Co., Ltd.); and SR2400, SR2405, and SR2406 (available from Dow Corning Toray Co., Ltd.). Specific examples of the modified silicone resins include, but are not limited to: ES-1001N (epoxy-modified), KR-5208 (acrylic-polymer-modified), KR-5203 (polyester-modified), and KR-206 (alkyd-modified), and KR-305 (urethane-modified) (available from Shin-Etsu Chemical Co., Ltd.); and SR2115 (epoxy-modified) and SR2110 (alkyd-modified) (available from Dow Corning Toray Co., Ltd.).

The silicone resin may be used alone or in combination with a cross-linkable component and/or a charge amount controlling agent. Examples of the cross-linkable component include silane coupling agents. Specific examples of the silane coupling agents include, but are not limited to, methyltrimethoxysilane, methyltriethoxysilane, octyltrimethoxysilane, and aminosilane coupling agents.

Fine Particles

The protective layer may optionally comprise fine particles. Examples of the fine particles include, but are not limited to: fine inorganic particles such as metal powders, tin oxide, zinc oxide, silica, titanium oxide, alumina, potassium titanate, barium titanate, and aluminum borate; conductive polymers such as polyaniline, polyacetylene, polyparaphenylene, poly(para-phenylene sulfide), polypyrrol, and parylene; and fine organic particles such as carbon black. Each of these materials can be used alone or in combination with others.

The fine particles may be surface-treated so as to have conductivity. Specifically, conductivity may be imparted to the fine particles by covering the surfaces thereof with a material, such as aluminum, zinc, copper, nickel, silver, an alloy thereof, zinc oxide, titanium oxide, tin oxide, antimony oxide, indium oxide, bismuth oxide, tin-doped indium oxide, antimony-doped tin oxide, and zirconium oxide, in the form of a solid solution or by means of fusion. Among these materials, tin oxide, indium oxide, and tin-doped indium oxide are preferable for imparting conductivity.

Preferably, the content rate of the protective layer in the carrier is 5% by mass or more, more preferably from 5% to 10% by mass.

Preferably, the thickness of the protective layer is from 0.1 to 5 μm, more preferably from 0.3 to 2 μm.

The thickness of the protective layer may be determined by cutting the carrier by focused ion beam (FIB), observing 50 or more points in the cross-sectional surface of the carrier with a transmission electron microscope (TEM) or a scanning transmission electron microscope (STEM) to measure a film thickness, and averaging the measured file thickness values.

Method of Forming Protective Layer of Carrier

The protective layer of the carrier may be formed by a known method, such as a method in which a protective layer solution dissolving raw materials of the protective layer, such as the binder resin or a precursor thereof, is sprayed to the surface of the core material, or another method in which the core material is dipped in the protective layer solution. Preferably, the protective layer solution is applied to the surface of the core material and thereafter heated, so that a polymerization of the binder resin or a precursor thereof can be accelerated. The heating treatment may be subsequently conducted within a coater after formation of the protective layer. Alternatively, the heating treatment may be conducted with another heater, such as an electric furnace and a calcination kiln, after formation of the protective layer.

The heating treatment temperature is determined depending on the types of constitutional materials of the protective layer. Preferably, the heating treatment temperature is about 120° C. to 350° C., and more preferably equal to lower than the decomposition temperature of the constitutional materials of the protective layer. Preferably, the upper limit of the decomposition temperature of the constitutional materials of the protective layer is about 220° C., and the heating treatment temperature is about 5 to 120 minutes.

Properties of Carrier

Preferably, the volume average particle diameter of the carrier is from 10 to 100 μm, more preferably from 20 to 65 μm. When the volume average particle diameter of the carrier is less than 10 μm, evenness of the core material may degrade and carrier deposition may occur. When the volume average particle diameter of the carrier is greater than 100 μm, reproducibility of image details is so poor that fine image cannot be obtained.

The volume average particle diameter may be measured by, for example, a particle size distribution analyzer MICROTRAC Model HRA9320-X100 (available from Nikkiso Co., Ltd.).

Preferably, the volume resistivity of the carrier is from 9 to 16 log(Ω·cm), more preferably from 10 to 14 log(Ω·cm). When the volume resistivity is less than 9 log(Ω·cm), carrier deposition may undesirably occur in non-image portions. When the volume resistivity is greater than 16 log(Ω·cm), the edge effect, that is a phenomenon in which image density of the edge portion is increased, remarkably occurs at the time of image development. The volume resistivity may be controlled by controlling the thickness of the protective layer or the content of the fine conductive particles.

The volume resistivity may be measured as follows. First, a cell made of a fluororesin container storing a pair of electrodes 1*a* and 1*b*, the distance therebetween being 0.2 cm and the area of each of which being 2.5 cm×4 cm, is filled with a carrier. The cell is thereafter subjected to tapping under the condition that the falling height is 1 cm, the tapping speed is 30 times per minute, and the number of tapping is 10 times. Next, a direct-current voltage of 1,000 V is applied to between the electrodes, and 30 seconds later, a resistance value r (Ω) is measured by a HIGH RESISTANCE METER 4329A (product of Yokogawa-Hewlett-Packard, Ltd.). The volume resistivity R (log(Ω·cm)) is calculated from the following formula (3).

$$R=\log\{r(\Omega)\times(2.5(\text{cm})\times 4\ (\text{cm}))/0.2\ (\text{cm})\} \qquad \text{Formula (3)}$$

In a case in which the developer is a two-component developer, preferably, the mixing ratio of the toner to the carrier is from 2.0% to 12.0% by mass, more preferably from 2.5 to 10.0% by mass.

Image Forming Method and Image Forming Apparatus

An image forming method according to an embodiment includes at least an electrostatic latent image forming process, a developing process, a transfer process, and a fixing process, and optionally a neutralization process, a cleaning process, a recycle process, and a control process.

An image forming apparatus according to an embodiment includes at least a photoconductor, an electrostatic latent image forming device, a developing device, a transfer device, and a fixing device, and optionally a neutralizer, a cleaner, a recycles, and a controller.

Electrostatic Latent Image Forming Process and Electrostatic Latent Image Forming Device The electrostatic latent image forming process is a process in which an electrostatic latent image is formed on a photoconductor (also referred to as an electrostatic latent image bearer).

The photoconductor is not limited in material, shape, structure, and size. For example, one preferred shape of the photoconductor is a drum-like shape. Specific examples of usable materials include, but are not limited to, inorganic photoconductors such as amorphous silicon and selenium, and organic photoconductors (OPC) such as polysilane and phthalopolymethine. Among these materials, amorphous silicone is preferable for long operating life.

An electrostatic latent image may be formed by, for example, uniformly charging a surface of the photoconductor and irradiating the surface with light containing image information by the electrostatic latent image forming device.

The electrostatic latent image forming device may include a charger to uniformly charge a surface of the photoconductor and an irradiator to irradiate the surface of the photoconductor with light containing image information.

A surface of the photoconductor may be charged by applying a voltage to the surface of the photoconductor by the charger.

Specific examples of the charger include, but are not limited to, contact chargers equipped with a conductive or semiconductive roller, brush, film, or rubber blade, and non-contact chargers utilizing corona discharge such as corotron and scorotron.

Preferably, the charger is disposed in contact with or out of contact with the photoconductor, and configured to charge a surface of the photoconductor by applying a direct-current voltage and an alternating-current voltage superimposed on one another.

It is also preferable that the charger is a charging roller disposed proximity to but out of contact with the photoconductor via a gap tape, configured to charge a surface of the photoconductor by applying a direct-current voltage and an alternating-current voltage superimposed on one another.

The surface of the photoconductor may be irradiated with light containing image information by the irradiator.

The irradiator has no limit so long as it is capable of emitting light containing image information to the surface of the photoconductor charged by the charger. Specific examples of the irradiator include, but are not limited to, various types of irradiators such as of radiation optical system type, rod lens array type, laser optical type, and liquid crystal shutter optical type.

It is also possible that the photoconductor is irradiated with light containing image information from a back surface thereof.

Developing Process and Developing Device

The developing process is a process in which the electrostatic latent image is developed into a visible image with the developer.

The visible image may be formed by developing the electrostatic latent image with the developer by the developing device.

The developing device is not limited in configuration so long as it is capable of developing an electrostatic latent image with the developer. Preferably, the developing device is capable of storing the developer and supplying the developer to the electrostatic latent image either by contact with or out of contact with the electrostatic latent image. More preferably, the developing device is equipped with a container containing the developer.

The developing device may be either a monochrome developing device or a multicolor developing device. Preferably, the developing device includes an agitator that frictionally agitates and charges the developer and a rotatable magnet roller.

In the developing device, toner particles and carrier particles are mixed and agitated. The toner particles are charged by friction and retained on the surface of the rotating magnet roller, thus forming magnetic brush. The magnet roller is disposed proximity to the photoconductor, so that a part of the toner particles composing the magnetic brush formed on the surface of the magnet roller are moved to the surface of the photoconductor by electric attractive force. As a result, the electrostatic latent image is developed with the toner particles and a visible image is formed with the toner particles on the surface of the photoconductor.

The developer stored in the developing device is the above-described developer according to an embodiment of the present invention.

Transfer Process and Transfer Device

The transfer process is a process in which the visible image is transferred onto a recording medium. It is preferable that the visible image is primarily transferred onto an intermediate transferor and then secondarily transferred onto the recording medium. Specifically, the transfer process includes a primary transfer process in which the visible image formed with two more toners with different colors, preferably in full colors, is transferred onto the intermediate transferor to form a composite transferred image, and a secondary transfer process in which the composite transferred image is transferred onto the recording medium.

The transfer process may be performed by charging the visible image by a transfer charger, by charging the photoconductor by the transfer device. The transfer device preferably includes a primary transfer device configured to transfer the visible image onto the intermediate transferor to form a composite transferred image and a secondary transfer device configured to transfer the composite transferred image onto a recording medium.

Specific examples of the intermediate transferor include, but are not limited to, a transfer belt.

The transfer device (including the primary transfer device and the secondary transfer device) preferably includes a transferrer configured to separate the visible image formed on the photoconductor to the recording medium side by charging. The number of the transfer devices is at least one.

Specific examples of the transferrer include, but are not limited to, corona transferrer, transfer belt, transfer roller, pressure transfer roller, and adhesive transferrer.

The recording medium is not limited to any particular material and conventional recording media can be used.

Fixing Process and Fixing Device

The fixing process is a process in which the visible image transferred onto the recording medium is fixed thereon. The fixing process may be performed every time each color developer is transferred onto the recording medium. Alternatively, the fixing process may be performed at once after all color developers are superimposed on one another on the recording medium. The fixing process may be performed by the fixing device.

The fixing device is not limited in configuration but preferably includes a heat-pressure member. Specific examples of the heat-pressure member include, but are not limited to, a combination of a heat roller and a pressure roller; and a combination of a heat roller, a pressure roller, and an endless belt.

Preferably, the fixing device includes a heater equipped with a heat generator, a film in contact with the heater, and a pressurizer pressed against the heater via the film, and is configured to allow a recording medium having an unfixed image thereon to pass through between the film and the pressurizer, so that the unfixed image is fixed on the recoding medium by application of heat. Preferably, the heating temperature of the heat-pressure member is from 80 to 200° C.

The fixing device may be used together with or replaced with an optical fixer.

The neutralization process is a process in which a neutralization bias is applied to the photoconductor to neutralize the photoconductor, and is preferably performed by a neutralizer.

The neutralizer is not limited in configuration so long as being capable of applying a neutralization bias to the photoconductor. Specific examples of the neutralizer include, but are not limited to, a neutralization lamp.

The cleaning process is a process in which residual toner particles remaining on the photoconductor are removed, and is preferably performed by a cleaner.

The cleaner is not limited in configuration so long as being capable of removing residual toner particles remaining on the photoconductor. Specific examples of the cleaner include, but are not limited to, a magnetic brush cleaner, an electrostatic brush cleaner, a magnetic roller cleaner, a blade cleaner, a brush cleaner, and a web cleaner.

The recycle process is a process in which the toner particles removed in the cleaning process are recycled for the developing device, and is preferably performed by a recycler. The recycler is not limited in configuration. Specific examples of the recycler include, but are not limited to, a conveyor.

The control process is a process in which the above-described processes are controlled, and is preferably performed by a controller.

The controller is not limited in configuration so long as being capable of controlling the above-described processes. Specific examples of the controller include, but are not limited to, a sequencer and a computer.

Image Forming Apparatus

The image forming apparatus according to an embodiment of the present invention is described in detail below.

Figure 3:
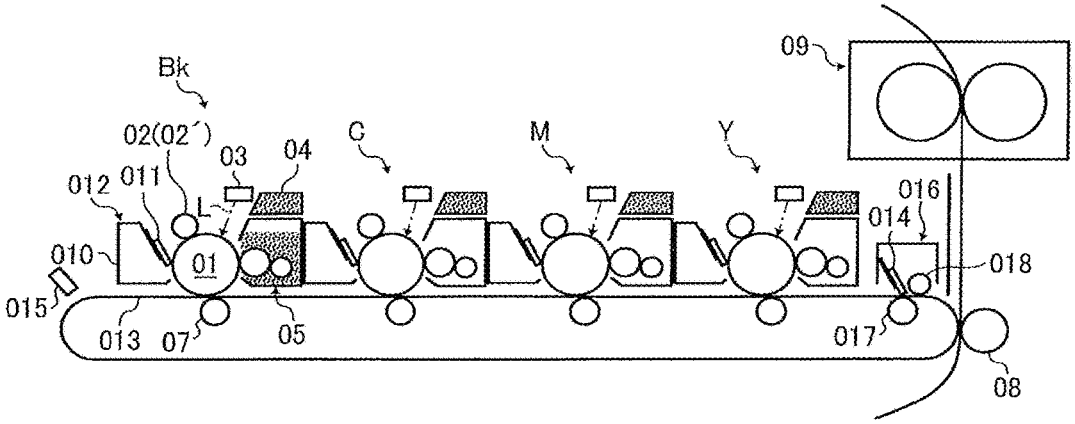
FIG. 3 is a schematic view of an image forming apparatus according to an embodiment of the present invention.

FIG. 3 is a schematic view of a tandem image forming apparatus according to an embodiment of the present invention.

Around a photoconductive drum 01 (hereinafter also referred to as "photoconductor 01") serving as an image bearer, the following members are provided in the following order: a charger 02 that charges a surface of the photoconductive drum 01, an irradiator 03 that emits laser light beam L to the uniformly-charged surface of the photoconductive drum 01 to form a latent image thereon, a developing device 05 that supplies charged toner to the latent image on the surface of the photoconductive drum 01 to form a toner image, a transfer device 07 that transfers the toner image formed on the surface of the photoconductive drum 01 onto a transferor, and a cleaner 012 that removes residual toner particles remaining on the photoconductive drum 01.

A toner supply container 04 that stores toner and supplies the toner to the developing device 05 is connected to an upper part of the developing device 05. The toner supply container 04 is replaceable. In the present embodiment, the toner supply container 04 is configured to supply toner directly to the developing device 05. Alternatively, the toner supply container 04 may be configured to supply toner to the developing device 05 through a supply path provided in the main body of the image forming apparatus.

In the tandem-type electrophotographic image forming apparatus, a single-color image, such as a black (Bk) image, a cyan (C) image, a magenta (M) image, and a yellow (Y) image, is formed on each photoconductor 01. One of these four images may be replaced with an image formed with the glittering toner according to an embodiment of the present invention. Alternatively, an additional unit for forming an image with the glittering toner may be provided to the image forming apparatus. Furthermore, a toner having different color or density or that for forming a colorless transparent image may be used in combination.

When image formation is performed by a negative-positive method in which the potential of the irradiated portion is lowered so that toner can adhere thereto, a charging roller 02' of the charger 02 uniformly and negatively charges a surface of the photoconductor 01, the irradiator 03 irradiates the charged surface with light beam L to form an electrostatic latent image thereon, and the developing device 05 supplies toner to the electrostatic latent image on the photoconductor 01 to form a toner image that is visible.

The toner image is transferred from the surface of the photoconductor 01 onto an intermediate transfer belt 013 by the transfer device 07. Residual toner particles remaining on the photoconductor 01 without being transferred onto the intermediate transfer belt 013 are removed by a cleaning blade 011 of the cleaner 012 and collected in a waste toner container 010. The toner image transferred onto the intermediate transfer belt 013 is further transferred onto a recording paper sheet fed from a sheet feeding tray at a secondary transfer portion as a bias is applied to a secondary transfer roller 08. Residual toner particles and external additives remaining on the transfer belt 013 after the secondary transfer are removed by a cleaning member 014. The toner image transferred onto the recording paper sheet is fixed thereon by a fixing device 09. The recording sheet having the fixed toner image thereon is ejected from a sheet ejection spout.

Referring to FIG. 3, a sensor 015 is disposed that measures the amount of toner transferred onto the intermediate transfer belt 013 and the position of each color image for adjusting image density and position. The sensor 015 combines a regular reflection method and a diffuse reflection method.

Referring to FIG. 3, a cleaning unit 016 is disposed that removes residual toner particles remaining on the surface of the intermediate transfer belt 013. The cleaning blade 014 is in contact with the intermediate transfer belt 013 so as to counter the direction of surface movement of the intermediate transfer belt 013. A metallic cleaning facing roller 017 is further disposed facing the cleaning blade 014. Toner particles removed by the cleaning blade 014 are conveyed to a waste toner storage by a coil 018.

Process Cartridge

A process cartridge according to an embodiment of the present invention includes a photoconductor and a developing device containing the above-described developer, configured to develop an electrostatic latent image on the photoconductor with the developer. The process cartridge is detachably mountable on an image forming apparatus body.

Figure 4:
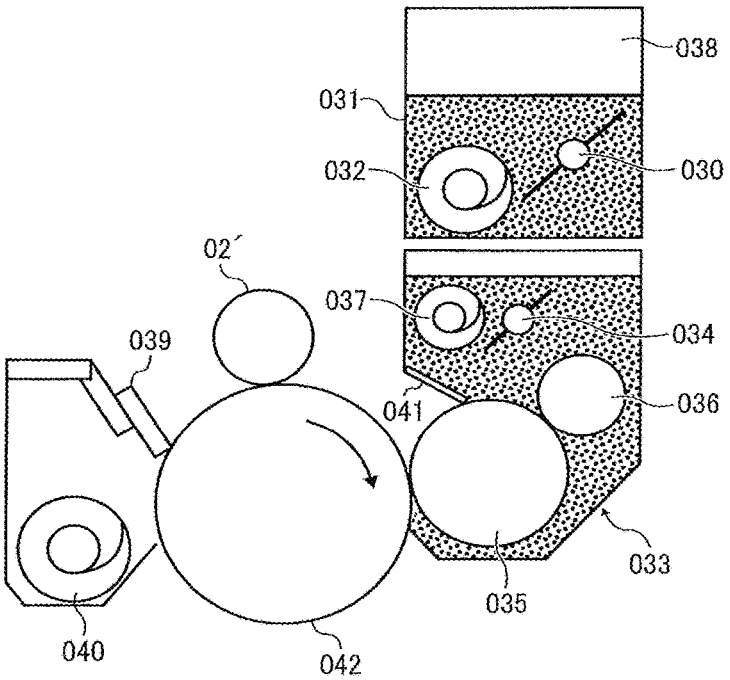
FIG. 4 is a schematic view of a process cartridge according to an embodiment of the present invention.

FIG. 4 is a schematic view of a process cartridge according to an embodiment of the present invention. The process cartridge illustrated in FIG. 4 is connected to a toner supply container. Specifically, the process cartridge is connected to a toner supply container 031. It is preferable that a stirring paddle 030 is disposed within a toner chamber 038 of the toner supply container 031, to constantly stir toner contained therein and maintain fluidity of the toner.

Within the toner supply container 031, a conveyer 032, such as a screw and a coil, is disposed. The conveyer 032 conveys toner toward a toner supply inlet where the toner supply container 031 is connected to a developing device 033 or a toner supply path of the image forming apparatus. The conveyer 032 is connectable to a driver disposed in the apparatus body by known means, such as a clutch, to be driven for toner supply. The amount of toner supply can be controlled by controlling the driving time of the driver. For example, the driving time can be varied by toner color, or in accordance with change in toner fluidity depending on temperature and humidity.

The developing device 033 includes: a toner transport member 037, such as a screw, that transports toner supplied from the toner supply container 031 to the whole area in a longitudinal direction; an agitator 034 that agitates toner within the developing device 033; a developing roller 035 serving as a toner bearer; a supply roller 036, mainly composed of a sponge material, that supplies toner to the developing roller 035; a regulation blade 041 that regulates the amount of toner on the developing roller 035 and frictionally charges the toner; and a power source that applies voltages to the developing roller 035, the supply roller 036, and the regulation blade 041.

The toner moved onto the developing roller 035 by the supply roller 036 is formed into a uniform toner layer by the regulation blade 041. The toner in an amount according to the surface potential of a photoconductive drum 042 is moved onto the surface of the photoconductive drum 042 and further transferred onto a transfer member by a transfer device. Residual toner particles remaining on the photoconductive drum 042 without being transferred are removed by a cleaner 039 and conveyed to a waste toner cartridge disposed in the image forming apparatus by a waste toner conveying screw 040.

Embodiments of the present invention are not limited to the above-described tandem image forming apparatus and further include a rotary-type image forming apparatus and a monochrome image forming apparatus.

EXAMPLES

The present invention is described in detail with reference to the following Examples but is not limited thereto. In the following descriptions, "parts" represents "parts by weight" unless otherwise specified.

Preparation of Aqueous Phase

In a reaction vessel equipped with a stirrer and a thermometer, 683 parts of water, 16 parts of a sodium salt of sulfate of ethylene oxide adduct of methacrylic acid (ELEMINOL RS-30 available from Sanyo Chemical Industries, Ltd.), 83 parts of styrene, 83 parts of methacrylic acid, 110 parts of n-butyl acrylate, and 1 part of ammonium persulfate were contained and stirred at a revolution of 400 rpm for 15 minutes. The vessel contents were heated to 75° C. and allowed to react for 5 hours. After 30 parts of a 1% by mass aqueous solution of ammonium persulfate was added to the vessel, the vessel contents were aged at 75° C. for 5 hours. Thus, a vinyl resin dispersion liquid was prepared. The volume average particle diameter of the vinyl resin dispersion liquid, measured by a laser diffraction particle size distribution analyzer LA-920 (available from Horiba, Ltd.), was 14 nm. The vinyl resin had an acid value of 45 mgKOH/g, a weight average molecular weight of 300,000, and a glass transition temperature of 60° C.

Next, 455 parts of water, 7 parts of the vinyl resin dispersion liquid, 17 parts of a 48.5% by mass aqueous solution of sodium dodecyl diphenyl ether disulfonate (ELEMINOL MON-7 available from Sanyo Chemical Industries, Ltd.), and 41 parts of ethyl acetate were stir-mixed. Thus, an aqueous phase in an amount of 520 parts was prepared.

Synthesis of Wax Dispersing Agent 1

In a reaction vessel equipped with a stirrer and a thermometer, 480 parts of xylene and 100 parts of a paraffin wax HNP-9 (available from Nippon Seiro Co., Ltd.) were contained and heated until they were dissolved. After the air in the vessel was replaced with nitrogen gas, the temperature was raised to 170° C. Next, a mixture liquid of 740 parts of styrene, 100 parts of acrylonitrile, 60 parts of butyl acrylate, 36 parts of di-t-butyl peroxyhexahydroterephthalate, and 100 parts of xylene was dropped in the vessel over a period of 3 hours, and the temperature was kept at 170° C. for 30 minutes. The solvent was thereafter removed. Thus, a wax dispersing agent 1 was prepared.

Preparation of Wax Dispersion Liquid W1

In a reaction vessel equipped with a stirrer and a thermometer, 150 parts of a paraffin wax HNP-9 (available from Nippon Seiro Co., Ltd.), 15 parts of the wax dispersing agent 1, and 335 parts of ethyl acetate were contained, heated to 80° C. while being stirred, and kept at 80° C. for 5 hours. The vessel contents were cooled to 30° C. over a period of 1 hour, and thereafter subjected to a dispersion treatment using a bead mill (ULTRAVISCOMILL available from Aimex Co., Ltd.) filled with 80% by volume of zirconia beads having a diameter of 0.5 mm at a liquid feeding speed of 1 kg/hour and a disc peripheral speed of 6 m/sec. This operation was repeated 3 times (3 passes). Thus, a wax dispersion liquid W1 was prepared. The particle diameter of the wax dispersion liquid W1, measured by an instrument LA-920 (available from HORIBA, Ltd.), was 350 nm. (Solid content concentration of the wax was 22.6%.)

Synthesis of Amorphous Polyester R2

In a reaction vessel equipped with a cooling tube, a stirrer, and a nitrogen introducing tube, 222 parts of ethylene oxide 2-mol adduct of bisphenol A, 129 parts of propylene oxide 2-mol adduct of bisphenol A, 166 parts of isophthalic acid, and 0.5 parts of tetrabutoxy titanate were contained. The vessel contents were thereafter allowed to react at 230° C. for 8 hours under nitrogen gas flow while removing produced water. Next, the vessel contents were allowed to react under reduced pressures of from 5 to 20 mmHg, cooled to 180° C. (normal pressure) at the time when the acid value became 2 mgKOH/g, and further allowed to react with 35 parts of trimellitic anhydride for 3 hours. Thus, an amorphous polyester R2 was prepared. The amorphous polyester R2 had a weight average molecular weight of 8,000 and a glass transition temperature of 62° C.

Example 1

Preparation of Oil Phase

In a vessel equipped with a thermometer and a stirrer, 100 parts of the amorphous polyester R2 was dissolved in 105 parts of ethyl acetate by stirring.

Next, 22 parts of the wax dispersion liquid Wl, 20 parts (based on solid contents) of a glittering pigment (a small-particle-diameter aluminum paste pigment, 2173YC available from Aluminium K.K., propyl acetate dispersion having a solid content of 50%), 1.6 parts of a yellow pigment (C.I. Pigment Yellow 139) were added to the vessel. The vessel contents were mixed by a TK HOMOMIXER (available from Primix Corporation) at a revolution of 5,000 rpm for 1 hour while keeping the inner temperature at 20° C. in ice bath, and ethyl acetate was thereafter added thereto so that the solid content concentration was adjusted to 50% by mass. Thus, an oil phase 1 was obtained, the actually-measured solid content concentration of which was 48.2%.

Next, in a vessel equipped with a stirrer and a thermometer, 550 parts of the aqueous phase was contained and kept at 20° C. in water bath.

Next, 450 parts of the oil phase 1 kept at 20° C. was added to the vessel, and the vessel contents were mixed by a TK HOMOMIXER (available from PRIMIX Corporation) at a revolution of 13,000 rpm for 1 minute while keeping the temperature at 20° C., thus obtaining an emulsion slurry. As a result of optical microscope observation, the resulting oil droplets were in a flat shape. In a vessel equipped with a stirrer and a thermometer, the emulsion slurry was contained and the solvent was removed therefrom at 40° C. under reduced pressures, thus obtaining a slurry containing 80% of oil droplets on solid basis.

The resulting slurry was mixed by a TK HOMOMIXER (available from PRIMIX Corporation) at a revolution of 8,000 rpm for 5 minutes while keeping the temperature at 20° C., thus applying a shearing stress to the slurry. As a result of optical microscope observation, the resulting oil droplets were in an ellipsoid-like shape. The solvent was further removed from the slurry at 40° C. under reduced pressures, thus obtaining a slurry containing 0% of volatile components of the organic solvent.

The slurry was thereafter filtered under reduced pressures. Next, 200 parts of ion-exchange water was added to the filter cake and mixed by a THREE-ONE MOTOR (available from Shinto Scientific Co., Ltd.) at a revolution of 800 rpm for 5 minutes for re-slurry, followed by filtration. Next, 10 parts of a 1% by mass aqueous solution of sodium hydroxide and 190 parts of ion-exchange water were added to the filter cake for re-slurry, followed by filtration. Next, 10 parts of a 1% by mass aqueous solution of hydrochloric acid and 190 parts of ion-exchange water were added to the filter cake for re-slurry, followed by filtration. Next, 300 parts of ion-exchange water was added to the filter cake for re-slurry, followed by filtration. This operation was repeated twice.

The filter cake was dried by a circulating air dryer at 45° C. for 48 hours and sieved with a mesh having an opening of 75 μm. Thus, mother particles were prepared.

Next, 100 parts of the mother particles and 1 part of a hydrophobized silica HDK-2000 (available from Wacker Chemie AG) were mixed by a HENSCHEL MIXER (available from Mitsui Mining and Smelting Co., Ltd.) at a peripheral speed of 30 m/s for 30 seconds, followed by a pause for 1 minute. This operation was repeated 5 times. The mixture was sieved with a mesh having an opening of 35 μm. Thus, a toner of Example 1 was prepared.

Examples 2 to 9 and Comparative Examples 1 and 2

The procedure in Example 1 was repeated except for changing the type and addition amount (based on 100 parts by weight of the glittering pigment) of the yellow pigment according to Table 1. Thus, toners of Examples 2 to 9 and Comparative Examples 1 and 2 were prepared.

In Table 1, "P.Y." and "P.R" denote "C.I. Pigment Yellow" and "C.I. Pigment Red", respectively.

Example 10

The procedure in Example 1 was repeated except for changing the type and addition amount (based on 100 parts by weight of the glittering pigment) of the yellow and magenta pigments according to Table 1. Thus, a toner of Example 10 was prepared.

Comparative Example 3

The procedure in Example 1 was repeated except for eliminating the yellow pigment. Thus, a toner of Comparative Example 3 was prepared.

Comparative Example 4

The procedure in Example 1 was repeated except for replacing the glittering pigment with an aluminum powder ground by a ball mill. Thus, a toner of Comparative Example 4 was prepared.

Evaluations

Disposition of Glittering Pigment

Whether or not the glittering pigment was disposed inside each toner was determined by observing a cross-section of the toner with a scanning electron microscope (SEM) and performing elemental analysis with an energy dispersive X-ray analyzer (EDS). As a result, the glittering pigment was disposed inside each of the toners of all the Examples and Comparative Examples 1 to 3. In Comparative Example 4, the glittering pigment was disposed at the surface of the toner.

Background Stains

Each toner was set in an electrophotographic apparatus (MP C6003 available from Ricoh Co., Ltd.) to produce a white solid image on 10,000 sheets. Toner particles deposited on the photoconductor during output of the white solid image were transferred onto a piece of SCOTCH tape, and the piece of tape was adhered to a white paper sheet. On the other hand, another piece of SCOTCH tape was adhered to a white paper sheet as it was. The color difference (AE) between the both pieces of tape was measured by a spectrodensitometer X-Rite 938 (available from X-Rite Inc.). The degree of background stains was evaluated based on ΔE according to the following criteria.

Evaluation Criteria

A: ΔE is less than 3

B: ΔE is 3 or more and less than 5

C: ΔE is 5 or more and less than 7

D: ΔE is 7 or more

Hue

Each toner was set in an image forming apparatus IMAGIO NEO C600 PRO (available from Ricoh Co., Ltd.) to form a solid image having a toner deposition amount of 0.50±0.10 mg/cm$^2$ and a size of 3 cm×8 cm on a coated paper sheet (POD GLOSS COAT PAPER available from Oji Paper Co., Ltd.). The hue angle of each image was measured by X-Rite 938 (available from X-Rite Inc.). Hue is determined based on the hue angle according to the following criteria. A, B, and C are acceptable levels.

Evaluation Criteria

A: 80 degrees or higher and lower than 95 degrees

B: 75 degrees or higher and lower than 80 degrees; or 95 degrees or higher and lower than 105 degrees C.: 65 degrees or higher and lower than 75 degrees; or 105 degrees or higher and lower than 115 degrees D: lower than 65 degrees; or 115 degrees or higher In each level of the above evaluation criteria, the obtained image has the following quality. In the levels A, B, and C, both glittering property and color tone are good.

A: Beautiful gold color

B: Slightly yellowish and reddish

C: Yellowish and reddish

D: Not gold color

The above evaluation results and toner compositions are presented in Table 1. In Table 1, the addition amount of each of yellow pigment and magenta pigment is based on 100 parts by weight of the glittering pigment.

TABLE 1

| | Glittering Pigment | Yellow Pigment | | Magenta Pigment | | Evaluation Results | |
|---|---|---|---|---|---|---|---|
| | Inside Toner? | Type | Addition Amount (parts by weight) | Type | Addition Amount (parts by weight) | Background Stains | Hue |
| Example 1 | Yes | P.Y.139 (Isoindoline Pigment) | 8 | — | — | B | C |
| Example 2 | Yes | P.Y.185 (Isoindoline Pigment) | 8 | — | — | A | C |
| Example 3 | Yes | P.Y.185 (Isoindoline Pigment) | 12 | — | — | A | C |
| Example 4 | Yes | P.Y.185 (Isoindoline Pigment) | 16 | — | — | A | C |
| Example 5 | Yes | P.Y.185 (Isoindoline Pigment) | 20 | — | — | A | B |
| Example 6 | Yes | P.Y.185 (Isoindoline Pigment) | 24 | — | — | A | B |
| Example 7 | Yes | P.Y.185 (Isoindoline Pigment) | 28 | — | — | A | B |
| Example 8 | Yes | P.Y.185 (Isoindoline Pigment) | 32 | — | — | A | C |
| Example 9 | Yes | P.Y.185 (Isoindoline Pigment) | 36 | — | — | B | C |
| Example 10 | Yes | P.Y.185 (Isoindoline Pigment) | 24 | P.R.122 | 4 | A | A |
| Comparative Example 1 | Yes | P.Y.74 (Non-Isoindoline Pigment) | 24 | — | — | D | B |
| Comparative Example 2 | Yes | P.Y.111 (Non-Isoindoline Pigment) | 24 | — | — | D | B |
| Comparative Example 3 | Yes | No Pigment | 0 | — | — | A | D |
| Comparative Example 4 | No | P.Y.185 (Isoindoline Pigment) | 20 | — | — | D | D |

It is clear from Table 1 that the toner of each Example delivers good results in evaluation of background stains. This means that charge reduction is suppressed. A reason for this is considered that charge reduction is suppressed not only by use of the isoindoline pigment but also by the disposition of the glittering pigment inside the toner. In addition, the hue degree of the toner of each Example falls within a preferred range. As a result, a glittering toner having a desirable hue is provided.

Example 11

Preparation of Coloring Pigment Dispersion Liquids

Preparation of Yellow Master Batch

First, 500 parts of water, 400 parts of a yellow pigment PY-185 (available from BASF), 600 parts of the amorphous polyester R2, and 12 parts of a carnauba wax (WA-05 available from TOA KASEI CO., LTD.) were mixed by a HENSCHEL MIXER (product of Mitsui Mining and Smelting Co., Ltd.). Next, the mixture was kneaded by a two-roll extruder at 150° C. for 30 minutes, cooled by rolling, and pulverized by a pulverizer (available from Hosokawa Micron Corporation). Thus, a master batch MBY-1 was prepared.

Preparation of Magenta Master Batch

The procedure for preparing the master batch MBY-1 was repeated except for replacing the yellow pigment with a magenta pigment PR-122 (available from Clariant). Thus, a master batch MBM-1 was prepared.

Preparation of Oil Phase

In a vessel equipped with a thermometer and a stirrer, 100 parts of the amorphous polyester R2 was dissolved in 105 parts of ethyl acetate by stirring. Next, 15 parts of the wax dispersion liquid W1, 7.5 parts of the yellow pigment master batch MBY-1, 1.5 parts of the magenta pigment master batch MBM-1, and 20 parts of a small-particle-diameter aluminum paste pigment (2173YC available from Toyo Aluminium K.K., propyl acetate dispersion having a solid content of 50%) were added to the vessel. The vessel contents were mixed by a TK HOMOMIXER (available from Primix Corporation) at a revolution of 5,000 rpm for 1 hour while keeping the inner temperature at 20° C. in ice bath. Thus, an oil phase 11 was obtained, the solid content concentration of which was adjusted to 50% by mass. The actually-measured solid content concentration thereof was 46.4%.

In a vessel equipped with a stirrer and a thermometer, 550 parts of the aqueous phase was contained and kept at 20° C. in water bath.

Next, 450 parts of the oil phase 11 kept at 20° C. was added to the vessel, and the vessel contents were mixed by a TK HOMOMIXER (available from PRIMIX Corporation) at a revolution of 13,000 rpm for 1 minute while keeping the temperature at 20° C., thus obtaining an emulsion slurry.

In a vessel equipped with a stirrer and a thermometer, the emulsion slurry was contained and the solvent was removed therefrom at 40° C. under reduced pressures, thus obtaining a slurry containing 80% of oil droplets on solid basis.

The resulting slurry was mixed by a TK HOMOMIXER (available from PRIMIX Corporation) at a revolution of 8,000 rpm for 5 minutes while keeping the temperature at 20° C., thus applying a shearing stress to the slurry. As a result of optical microscope observation, the resulting oil droplets were in an ellipsoid-like shape. The solvent was further removed from the slurry at 40° C. under reduced pressures, thus obtaining a slurry containing 0% of volatile components of the organic solvent.

The slurry was thereafter filtered under reduced pressures. Next, 200 parts of ion-exchange water was added to the filter cake and mixed by a THREE-ONE MOTOR (available from Shinto Scientific Co., Ltd.) at a revolution of 800 rpm for 5 minutes for re-slurry, followed by filtration. Next, 10 parts of a 1% by mass aqueous solution of sodium hydroxide and 190 parts of ion-exchange water were added to the filter cake for re-slurry, followed by filtration. Next, 10 parts of a 1% by mass aqueous solution of hydrochloric acid and 190 parts of ion-exchange water were added to the filter cake for re-slurry, followed by filtration. Next, 300 parts of ion-exchange water was added to the filter cake for re-slurry, followed by filtration. This operation was repeated twice.

The filter cake was dried by a circulating air dryer at 45° C. for 48 hours and sieved with a mesh having an opening of 75 μm. Thus, mother particles were prepared.

Next, 100 parts of the mother particles and 1 part of a hydrophobized silica HDK-2000 (available from Wacker Chemie AG) were mixed by a HENSCHEL MIXER (available from Mitsui Mining and Smelting Co., Ltd.) at a peripheral speed of 30 m/s for 30 seconds, followed by a pause for 1 minute. This operation was repeated 5 times. The mixture was sieved with a mesh having an opening of 35 μm. Thus, a toner of Example 11 was prepared.

In the toner of Example 11, 80% of the coloring pigment particles were disposed at the position A and 75% of the glittering pigment particles were disposed at the position B. In Examples and Comparative Examples, the rates of the coloring pigment particles and the glittering pigment particles disposed at the the positions A and B, respectively, were measured by the above-described procedure.

Example 12

Preparation of Yellow Master Batch

First, 500 parts of water, 400 parts of a yellow pigment PY-185 (available from BASF), 600 parts of the amorphous polyester R2, and 24 parts of a carnauba wax (WA-05 available from TOA KASEI CO., LTD.) were mixed by a HENSCHEL MIXER (product of Mitsui Mining and Smelting Co., Ltd.). Next, the mixture was kneaded by a two-roll extruder at 150° C. for 30 minutes, cooled by rolling, and pulverized by a pulverizer (available from Hosokawa Micron Corporation). Thus, a master batch MBY-2 was prepared.

The master batch MBY-2 contains the carnauba wax, that has a high polarity, in a larger amount than the master batch MBY-1 does. Therefore, polar groups of the wax are adsorbed to the surface of the yellow pigment in a large amount.

Preparation of Magenta Master batch

The procedure for preparing the master batch MBY-2 was repeated except for replacing the yellow pigment with a magenta pigment PR-122 (available from Clariant). Thus, a master batch MBM-2 was prepared.

A toner of Example 12 was prepared in the same manner as the toner of Example 11. In the toner of Example 12, 85% of the coloring pigment particles were disposed at the position A and 75% of the glittering pigment particles were disposed at the position B.

Example 13

Preparation of Yellow Master Batch

First, 500 parts of water, 400 parts of a yellow pigment PY-185 (available from BASF), 600 parts of the amorphous polyester R2, and 12 parts of an alcohol-modified wax (UNILIN 425 product of Baker Petrolite) were mixed by a HENSCHEL MIXER (product of Mitsui Mining and Smelting Co., Ltd.). Next, the mixture was kneaded by a two-roll extruder at 150° C. for 30 minutes, cooled by rolling, and pulverized by a pulverizer (available from Hosokawa Micron Corporation). Thus, a master batch MBY-3 was prepared.

The master batch MBY-3 contains the alcohol-modified wax that includes a large number of ester groups and has a much higher polarity. Therefore, polar groups of the wax are adsorbed to the surface of the yellow pigment in a larger amount. Preparation of Magenta Master Batch The procedure for preparing the master batch MBY-3 was repeated except for replacing the yellow pigment with a magenta pigment PR-122 (available from Clariant). Thus, a master batch MBM-3 was prepared.

A toner of Example 13 was prepared in the same manner as the toner of Example 11. In the toner of Example 13, 90% of the coloring pigment particles were disposed at the position A and 75% of the glittering pigment particles were disposed at the position B.

Example 14

The procedure in Example 11 was repeated except that the glittering pigment was changed to a resin-coated small-particle-diameter aluminum paste pigment (2173EAYC available from Toyo Aluminium K.K., propyl acetate dispersion having a solid content of 50%) in an amount of 20 parts, so that the glittering pigment was disposed more inside the toner. The subsequent treatments were performed in the same manner as in Example 11, thus obtaining a toner of Example 14.

In the toner of Example 14, 90% of the coloring pigment particles were disposed at the position A and 80% of the glittering pigment particles were disposed at the position B.

Example 15

The procedure in Example 11 was repeated except that the glittering pigment was changed to an acrylic-resin-coated small-particle-diameter aluminum paste pigment (PK-20R available from Toyo Aluminium K.K., mineral spirit dispersion having a solid content of 50%) in an amount of 20 parts, so that the glittering pigment was disposed more inside the toner. The subsequent treatments were performed in the same manner as in Example 11, thus obtaining a toner of Example 15.

In the toner of Example 15, 90% of the coloring pigment particles were disposed at the position A and 90% of the glittering pigment particles were disposed at the position B.

Comparative Example 11

Preparation of Resin Fine Particle Dispersion Liquid

In a flask, 100 parts of the amorphous polyester R2 was dissolved in 100 parts of methyl ethyl ketone by stirring with a THREE-ONE MOTOR at a revolution of 600 rpm at 20° C. Further, 7 parts of ammonia water (28% by weight) was added to the flask and homogenized by stirring. Next, 200 parts of ion-exchange water was gradually added to the flask using a dropping funnel over a period of 1 hour. It was confirmed that the liquid had once become clouded and thickened but the viscosity had reduced with continuous dropping of ion-exchange water. Therefore, it was presumed that the resin solution had underwent phase-inversion.

The resulting resin dispersion liquid was thereafter subjected to pressure reduction at 40° C. so that the solvent was removed therefrom. Thus, a resin fine particle dispersion liquid 1 was prepared. The resin fine particles contained in the resin fine particle dispersion 1 (having a resin fine particle concentration of 33%) had a volume average particle diameter of 80 nm when measured by a MICROTRAC UPA (available from Nikkiso Co., Ltd.).

Preparation of Wax Dispersion Liquid

In a vessel equipped with a stirrer and a thermometer, 150 parts of a paraffin wax HNP-9 (available from Nippon Seiro Co., Ltd.), 3 parts of sodium dodecylbenzene sulfonate, and 450 parts of ion-exchange water were contained. The vessel contents were stirred at 80° C. and subjected to a dispersion treatment using a bead mill (ULTRAVISCOMILL available from Aimex Co., Ltd.) filled with 80% by volume of zirconia beads having a diameter of 0.5 mm at a liquid feeding speed of 1 kg/hour and a disc peripheral speed of 6 m/sec. This operation was repeated 3 times (3 passes). Thus, a wax dispersion liquid W2 was prepared. After being cooled to 20° C., the wax dispersion liquid W2 was subjected to a measurement of particle diameter by an instrument MICROTRAC UPA (available from Nikkiso Co., Ltd.). As a result, the particle diameter was 220 nm (the solid content concentration of the wax was 25%).

Preparation of Emulsion Aggregation Toner

First, 300 parts of the resin fine particle dispersion liquid 1, 10 parts of the wax dispersion liquid W2, 10 parts of an aluminum pigment powder (1200M available from Toyo Aluminium K.K), 3 parts of a yellow pigment PY-185 (available from BASF), 0.5 parts of a magenta pigment PR-122 (available from Clariant), and 200 parts of ion-exchange water were contained in a vessel. The vessel contents were mixed by a TK HOMOMIXER (available from Primix Corporation) at a revolution of 8,000 rpm for 3 hours while keeping the inner temperature at 20° C. in ice bath.

The mixture was stirred by a THREE-ONE MOTOR equipped with a paddle stirring blade at a revolution or 300 rpm and a 10% aqueous solution of aluminum chloride was dropped therein, while confirming formation of aggregated particles with an optical microscope. At the same time, the pH of the system was maintained at 3 to 4 by using hydrochloric acid. After confirmation of formation of aggregated particles, the inner temperature was raised to 65° C. and maintained for 1 hour for sintering particles. The resulting aggregated particles were in a flat shape, and the volume average particle diameter (D4) thereof was 13.5 μm when measured by a MULTISIZER III available from Beckman Coulter, Inc.

After the series of filtration, re-slurry, and water washing was repeated for 5 times and when the conductivity of the slurry became 50 μS/cm, the filter cake was dried by a circulating air dryer at 45° C. for 48 hours and sieved with a mesh having an opening of 75 μm. Thus, mother toner particles were prepared.

Next, 100 parts of the mother particles and 1 part of a hydrophobized silica HDK-2000 (available from Wacker Chemie AG) were mixed by a HENSCHEL MIXER (available from Mitsui Mining and Smelting Co., Ltd.) at a peripheral speed of 30 m/s for 30 seconds, followed by a pause for 1 minute. This operation was repeated 5 times. The mixture was sieved with a mesh having an opening of 35 μm. Thus, a toner of Comparative Example 11 was prepared. The resulting toner particles were in a flat shape, and the volume average particle diameter (D4) thereof was 12.5 μm when measured by a MULTISIZER III available from Beckman Coulter, Inc.

In the toner of Comparative Example 11, 75% of the coloring pigment particles were disposed at the position A and 50% of the glittering pigment particles were disposed at the position B.

Comparative Example 12

Preparation of Toner by Two-Step Aggregation

Preparation of Organic Pigment Dispersion

First, 3 parts of a yellow pigment PY-185 (available from BASF), 0.5 parts of a magenta pigment PR-122 (available from Clariant), 100 parts of ion-exchange water, and 1 part of sodium dodecylbenzene sulfonate were contained in a vessel. The vessel contents were mixed by a TK HOMOMIXER (available from Primix Corporation) at a revolution of 8,000 rpm for 3 hours while keeping the inner temperature at 20° C. in ice bath. Thus, an organic pigment dispersion 1 was prepared.

Preparation of Glittering Pigment Dispersion

First, 10 parts of an aluminum pigment powder (1200M available from Toyo Aluminium K.K), 100 parts of ion-exchange water, and 1 part of sodium dodecylbenzene sulfonate were contained in a vessel. The vessel contents were mixed by a TK HOMOMIXER (available from Primix Corporation) at a revolution of 8,000 rpm for 3 hours while keeping the inner temperature at 20° C. in ice bath. Thus, a glittering pigment dispersion 1 was prepared.

Preparation of Resin-Wax Dispersion

First, 300 parts of the resin fine particle dispersion liquid 1 and 10 parts of the wax dispersion liquid W2 were contained in a vessel. The vessel contents were mixed by a TK HOMOMIXER (available from Primix Corporation) at a revolution of 8,000 rpm for 3 hours while keeping the inner temperature at 20° C. in ice bath. Thus, a resin-wax dispersion 1 was prepared.

First, 50% of the above-prepared resin-was dispersion 1, 30% of the above-prepared organic pigment dispersion 1, and 30% of the above-prepared glittering pigment dispersion 1 were mixed. The mixture was stirred by a THREE-ONE MOTOR equipped with a paddle stirring blade at a revolution or 300 rpm and a 10% aqueous solution of aluminum chloride was dropped therein, while confirming formation of aggregated particles with an optical microscope.

At the same time, the pH of the system was maintained at 3 to 4 by using hydrochloric acid. Next, the remaining 50% of the above-prepared resin-was dispersion 1, the remaining 70% of the above-prepared organic pigment dispersion 1, and the remaining 70% of the above-prepared glittering pigment dispersion 1 were mixed. The resulting mixture was mixed in the aggregated particles obtained above.

A 10% aqueous solution of aluminum chloride was dropped therein, while confirming formation of aggregated particles with an optical microscope. At the same time, the pH of the system was maintained at 3 to 4 by using hydrochloric acid. After confirmation of formation of aggregated particles, the inner temperature was raised to 65° C. and maintained for 1 hour for sintering particles. The resulting aggregated particles were in a flat shape, and the volume average particle diameter (D4) thereof was 14.0 μm when measured by a MULTISIZER III available from Beckman Coulter, Inc. The subsequent treatments were performed in the same manner as in Comparative Example 11, thus obtaining a toner of Comparative Example 12 having a volume average particle diameter of 13.3 μm.

In the toner of Comparative Example 12, 65% of the coloring pigment particles were disposed at the position A and 35% of the glittering pigment particles were disposed at the position B.

Comparative Example 13

Preparation of Toner by Two-Step Aggregation

First, 50% of the above-prepared resin-was dispersion 1, 80% of the above-prepared organic pigment dispersion 1, and 10% of the above-prepared glittering pigment dispersion 1 were mixed. The mixture was stirred by a THREE-ONE MOTOR equipped with a paddle stirring blade at a revolution or 300 rpm and a 10% aqueous solution of aluminum chloride was dropped therein, while confirming formation of aggregated particles with an optical microscope.

At the same time, the pH of the system was maintained at 3 to 4 by using hydrochloric acid. Next, the remaining 50% of the above-prepared resin-was dispersion 1, the remaining 20% of the above-prepared organic pigment dispersion 1, and the remaining 90% of the above-prepared glittering pigment dispersion 1 were mixed. The resulting mixture was mixed in the aggregated particles obtained above.

A 10% aqueous solution of aluminum chloride was dropped therein, while confirming formation of aggregated particles with an optical microscope. At the same time, the pH of the system was maintained at 3 to 4 by using hydrochloric acid. After confirmation of formation of aggregated particles, the inner temperature was raised to 65° C. and maintained for 1 hour for sintering particles. The resulting aggregated particles were in a flat shape, and the volume average particle diameter (D4) thereof was 13.0 μm when measured by a MULTISIZER III available from Beckman Coulter, Inc. The subsequent treatments were performed in the same manner as in Comparative Example 11, thus obtaining a toner of Comparative Example 13 having a volume average particle diameter of 12.8 μm.

In the toner of Comparative Example 13, 20% of the coloring pigment particles were disposed at the position A and 20% of the glittering pigment particles were disposed at the position B.

Toner Evaluation Methods

Glittering Property Rank

Each toner was set in an image forming apparatus IMAGIO NEO C600 PRO (available from Ricoh Co., Ltd.) to form a solid image having a toner deposition amount of 0.50±0.10 mg/cm$^2$ and a size of 3 cm×8 cm on a coated paper sheet (POD GLOSS COAT PAPER available from Oji Paper Co., Ltd.). The solid image was formed on the sheet at a position 3.0 cm away from the leading edge in the sheet feeding direction. Image samples were formed on respective sheets at respective temperatures of the fixing belt ranging from 130° C. to 180° C. at an interval of 10° C.

The degree of reflection of each image sample at the angle at which the reflected light became the highest under ordinary lighting in the office room were evaluated into 5 ranks as follows. Among the image samples formed at different temperatures of the fixing belt, the one with the highest evaluation was used as a representative sample.

Rank 1 (E): Reflectivity is the same level as that of coated paper.

Rank 2 (D): The amount of reflected light is changed little even when the angle is changed.

Rank 3 (C): As the angle is changed, there is a region where the amount of reflected light is increased in one direction.

Rank 4 (B): As the angle is changed, there is a large reflective region in one direction.

Rank 5 (A): As the angle is changed, there is a region where the amount of reflected light is increased in one direction.

Gloss Rank

The gloss of each image was evaluated from the direction of reflection as follows.

Rank 1 (E): Mat tone, no glossiness

Rank 2 (D): As the angle is changed, there is a slightly glossy region in one direction.

Rank 3 (C): As the angle is changed, there is a glossy region.

Rank 4 (B): As the angle is changed, there is a glossy region with a wide area.

Rank 5 (A): As the angle is changed, there is a very glossy region with a wide area.

Color Tone

The color tone of each image was evaluated with a colorimeter.

Specifically, CIE La*b* values were measured by an instrument X-RITE 938 (available from X-Rite Inc.). Measurement conditions were as follows.

Light source: D50

Light measurement: Light receiving 0°, Illuminance 45°

Color measurement: 2° field of view

Measurement: performed on 10 sheets of glossy paper layered

Rank 1 (E): $-5 \leq a^* \leq 10$ and $0 \leq b^* \leq 10$

Rank 2 (D): $-5 \leq a^* \leq 10$ and $0 \leq b^* \leq 25$

Rank 3 (C): $-5 \leq a^* \leq 5$ and $0 \leq b^* \leq 40$

Rank 4 (B): $0 \leq a^* \leq 5$ and $0 \leq b^* \leq 50$

Rank 5 (A): $0 \leq a^* \leq 5$ and $b^* > 50$

Amount of Charge

The amount of charge of each toner was measured using a device which includes: a conductive toner bearer that bears toner on its surface; a toner supply unit, disposed facing the toner bearer, that supplies charged toner to the toner bearer; a power source that forms an electric field between the toner bearer and the toner supply unit to attract the toner to the toner bearer; a driver that drives the toner bearer and the toner supply unit; and a charge measurement unit that measures an amount of charge of the toner attracted to the surface of the toner bearer. In this device, charged toner is attracted to the toner supply unit and then transferred onto the toner bearer by electrostatic force. The amount of charge of the toner bearer was measured both in a state in which the toner was kept attracted to the toner bearer and another state in which after the toner had been removed from the toner bearer. The amount of charge of the toner was determined from the difference therebetween.

Specific examples of the toner supply unit include a cylindrical developing roll made of a conductive material such as aluminum, non-magnetic stainless steel, copper, and brass.

Inside the developing roll, a magnet having multiple magnetic poles is disposed. Due to the magnetic force of this magnet, a uniform developer layer can be formed on the outer circumferential surface of the developing roll.

Specific examples of the toner bearer include a developed roll made of a metal, such as aluminum, stainless steel, copper, and brass, or a conductive material, such as conductive plastics.

The device is configured such that each of the developing roll and the developed roll is applied with a separate bias voltage independently variable.

The bias voltage is set according to the charge polarity of the toner and whether a toner layer is formed on the developed roll by a normal developing method or a reverse developing method.

As the developing roll and the developed roll are driven to rotate by applying bias voltages thereto, a uniform toner layer is formed on the developed roll by a electrophotographic development process.

After the toner layer is formed on the developed roll, the amount of charge Q held by the developed roll is measured, which has been increased as compared with that before formation of the toner layer.

In addition, the mass M of toner held on the developed roll is determined by measuring, using a balance, the mass of the developing roll in a state holding toner and a state after the toner is removed therefrom.

A parameter Q/M that indicates developing property of toner can be determined by the above-measured amount of charge Q and mass M.

Log R (Resistance)

The common logarithm of volume resistivity (R) of toner (hereinafter "Log R") was measured as follows. First, 3 g of each toner was molded into a pellet having a diameter of 40 mm and a thickness of about 2 mm using a presser BRE-32 (available from MAEKAWA TESTING MACHINE MFG. Co., Ltd., with a load of 6 MPa and a pressing time of 1 minute).

The pellet was set to electrodes for solid (SE-70 product of Ando Electric Co., Ltd.) and an alternating current of 1 kHz was applied to between the electrodes. At this time, Log R was measured by an alternating-current-bridge measuring instrument composed of a dielectric loss measuring instrument TR-10C, an oscillator WBG-9, and an equilibrium point detector BDA-9 (all products of Ando Electric Co., Ltd.), and evaluated based on the following criteria.

D: Log R<9.5

C: 9.5≤Log R<10.0

B: 10.0≤Log R<10.5

A: Log R≥10.5

Results are presented in Table 2.

TABLE 2

| | Example 11 | Example 12 | Example 13 | Example 14 | Example 15 | Comparative Example 11 | Comparative Example 12 | Comparative Example 13 |
|---|---|---|---|---|---|---|---|---|
| Rate of Coloring Pigment Particles at Position A (%) | 80 | 85 | 90 | 90 | 90 | 75 | 65 | 20 |
| Rate of Glittering Pigment Particles at Position B (%) | 75 | 75 | 75 | 80 | 90 | 50 | 35 | 20 |
| Glittering Property Rank | B | B | A | A | A | C | D | E |
| Gloss Rank | B | B | A | A | A | D | D | E |
| Color Tone (a*b*) | C | B | A | A | A | C | D | E |
| Amount of Charge (Q/M) (μC/g) | −15 | −21 | −25 | −27 | −34 | −11 | −9 | −5 |

TABLE 2-continued

| | Example 11 | Example 12 | Example 13 | Example 14 | Example 15 | Comparative Example 11 | Comparative Example 12 | Comparative Example 13 |
|---|---|---|---|---|---|---|---|---|
| LogR (LogΩcm) | C (99) | B (100) | B (10.1) | B (10.3) | A (10.8) | C (9.7) | C (9.5) | D (9.3) |

It is clear from Table 2 that, in each toner according to Examples, 80% or more of the coloring pigment particles are disposed at the position A and 75% or more of the glittering pigment particles are disposed at the position B. Each of these toners imparts excellent glittering property to the resulting image and easily controls color tone thereof, while preventing deterioration of electric and charge properties.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A toner comprising:

a glittering pigment disposed inside the toner; and a coloring pigment comprising a yellow pigment comprising an isoindoline pigment, wherein a content of the coloring pigment is from 10 to 35 parts by weight based on 100 parts by weight of the glittering pigment.

2. The toner of claim 1, wherein the isoindoline pigment comprises C.I. Pigment Yellow 185.

3. The toner of claim 1, wherein the coloring pigment further comprises a magenta pigment.

4. A developer comprising the toner of claim 1.

5. A process cartridge detachably mountable on an image forming apparatus, comprising:

a photoconductor; and a developing device containing the developer of claim 4, configured to develop an electrostatic latent image on the photoconductor with the developer.

6. An image forming apparatus comprising:

a photoconductor;

an electrostatic latent image forming device configured to form an electrostatic latent image on the photoconductor;

a developing device containing the developer of claim 4, configured to develop the electrostatic latent image on the photoconductor with the developer to form a toner image;

a transfer device configured to transfer the toner image onto a recording medium; and a fixing device configured to fix the transferred toner image on the recording medium.

7. An image forming method comprising:

forming an electrostatic latent image on a photoconductor;

developing the electrostatic latent image with the developer of claim 4 to form a toner image;

transferring the toner image onto a recording medium; and fixing the transferred toner image on the recording medium.

8. A toner comprising:

glittering pigment particles; and coloring pigment particles, wherein 80% or more of the coloring pigment particles are disposed at a position A and 75% or more of the glittering pigment particles are disposed at a position B, wherein the position A and the position B are on a line connecting a center of gravity of the toner as a start point to a surface of the toner as an end point via a center of gravity of each of the coloring pigment particles and glittering pigment particles, and a distance from the start point to the position A is 0.6 times or more a total distance between the start point and the end point and a distance from the start point to the position B is less than 0.6 times the total distance.

9. The toner according to claim 8, wherein the isoindoline pigment comprises C.I. Pigment Yellow 185.

10. A method for manufacturing toner, comprising:

dispersing an organic liquid, comprising a glittering pigment and a coloring pigment, in an aqueous medium to form an oil-in-water (O/W) emulsion, wherein the coloring pigment comprises a yellow pigment comprising an isoindoline pigment, and wherein a content of the coloring pigment is from 10 to 35 parts by weight based on 100 parts by weight of the glittering pigment.

* * * * *